US011390955B2

(12) United States Patent
Fujinuma

(10) Patent No.: US 11,390,955 B2
(45) Date of Patent: Jul. 19, 2022

(54) ELECTROCHEMICAL CELL, ELECTROCHEMICAL SYSTEM, AND METHOD OF PRODUCING CARBONATE COMPOUND

(71) Applicant: SEKISUI CHEMICAL CO., LTD., Osaka (JP)

(72) Inventor: Naohiro Fujinuma, Glassboro, NJ (US)

(73) Assignee: SEKISUI CHEMICAL CO., LTD., Osaka (JP)

( * ) Notice: Subject to any disclaimer, the term of this patent is extended or adjusted under 35 U.S.C. 154(b) by 176 days.

(21) Appl. No.: 16/534,286

(22) Filed: Aug. 7, 2019

(65) Prior Publication Data

US 2021/0040626 A1 Feb. 11, 2021

(51) Int. Cl.

| | |
|---|---|
| ***C25B 9/19*** | (2021.01) |
| ***C25B 15/08*** | (2006.01) |
| ***C25B 3/25*** | (2021.01) |
| ***C25B 9/70*** | (2021.01) |

(52) U.S. Cl.

CPC ..... *C25B 9/19* (2021.01); *C25B 3/25* (2021.01); *C25B 9/70* (2021.01); *C25B 15/08* (2013.01)

(58) Field of Classification Search

CPC . C25B 3/25–3/26; C25B 15/08; C25B 15/087
USPC ..... 204/237; 205/349
See application file for complete search history.

(56) References Cited

U.S. PATENT DOCUMENTS

| | | | | |
|---|---|---|---|---|
| 5,268,081 | A * | 12/1993 | Dousek | C25B 1/04 204/237 |
| 8,734,624 | B2 * | 5/2014 | Minami | C25D 5/08 204/269 |
| 2018/0179649 | A1 * | 6/2018 | Fleischer | C25B 3/25 |
| 2019/0055656 | A1 * | 2/2019 | Kenis | C25B 3/25 |
| 2020/0095692 | A1 * | 3/2020 | Fujinuma | C07C 271/10 |

FOREIGN PATENT DOCUMENTS

| | | |
|---|---|---|
| JP | 2003-213472 | 7/2003 |
| JP | 5017499 | 9/2012 |
| JP | 5376381 | 12/2013 |
| WO | 2012/077198 | 6/2012 |
| WO | 2019/065258 | 4/2019 |

OTHER PUBLICATIONS

Yu et al, Electrosynthesis of Dimethyl Carbonate from Methanol and Carbon Monoxide under Mild Conditions, Industrial & Engineering Chemistry Research, vol. 52, No. 21, May 2013, pp. 6901-6907 (Year: 2013).*

(Continued)

*Primary Examiner* — Harry D Wilkins, III
(74) *Attorney, Agent, or Firm* — Wenderoth, Lind & Ponack, L.L.P.

(57) ABSTRACT

There is provided an electrochemical cell, including a cathode, an anode, and an ion exchange membrane disposed between the cathode and the anode, wherein the cathode includes a first catalyst capable of catalyzing a reduction reaction for reducing carbon dioxide into carbon monoxide, and the anode includes a second catalyst capable of catalyzing a carbonylation reaction for producing a carbonate compound from carbon monoxide and an alcohol compound.

17 Claims, 3 Drawing Sheets

(56) References Cited

OTHER PUBLICATIONS

Lu et al., "Electrochemical CO2 reduction: Electrocatalyst, reaction mechanism, and process engineering", Nano Energy 29 (2016) p. 439-456.
Funakawa et al., "High Efficient Electrochemical Carbonylation of Methanol to Dimethyl Carbonate by $Br_2$/Br− Mediator System over Pd/C Anode", Journal of the Electrochemical Society, 153(4), D68 (2006).
Kanega et al., "Electrosynthesis of diphenyl carbonate by homogeneous Pd electrocatalysts Au nanoparticles on graphene as efficient anodes", Catalysis Science & Technology, 2016, 6, p. 6002-6010.

* cited by examiner

ELECTROCHEMICAL CELL, ELECTROCHEMICAL SYSTEM, AND METHOD OF PRODUCING CARBONATE COMPOUND

FIELD OF THE INVENTION

The present invention relates to an electrochemical cell, an electrochemical system, and a method of producing a carbonate compound in the electrochemical cell and the electrochemical system.

BACKGROUND OF THE INVENTION

A carbon dioxide reducing apparatus for producing valuables by electrical reduction of carbon dioxide is of interest as a means for reducing carbon dioxide emissions and storing natural energy, and thus is researched and developed (Non Patent Literature 1). A carbon dioxide reducing apparatus in which an electrochemical cell is used is known. For example, metals, alloys, metal-carbon compounds, carbon compounds, and the like are reported as a catalyst for enabling efficient proceeding of a reaction in which carbon dioxide is reduced into carbon monoxide and the like at a cathode of an electrochemical cell (Patent Literature 1 to 3). Patent Literature 4 discloses that a first electrode constituting a cathode is a porous electrode having porous carbon, wherein the porous carbon has at least one bond between a metal element and a nonmetal element represented by M-R (note that M is a metal element of Groups 4 to 15, and R is a nonmetal element of Groups 14 to 16). The development regarding the electrochemical cells reported in these literatures has focused only on the reaction at the cathode, and there are few examples of the development targeted for the anode of the identical electrochemical cell conventionally.

On the other hand, several organic compound oxidizing apparatuses for producing valuables by oxidation of an organic compound have been reported up to now (for example, Patent Literature 5, and Non Patent Literatures 2 and 3). The development regarding the organic compound oxidizing apparatuses reported in these literatures has focused on the anode at which the oxidation reaction occurs, and has been hardly targeted for the cathode.

CITATION LIST

Patent Literature

[Patent Literature 1] Japanese Patent No. 5376381
[Patent Literature 2] Japanese Patent Laid-Open No. 2003-213472
[Patent Literature 3] Japanese Patent No. 5017499
[Patent Literature 4] International Publication No. 2019/065258
[Patent Literature 5] International Publication No. 2012/077198

Non Patent Literature

[Non Patent Literature 1] Nano Energy 29 (2016) 439-456
[Non Patent Literature 2] Journal of the Electrochemical Society, 153(4), D68 (2006)
[Non Patent Literature 3] Catal. Sci. Technol. 2016, 6, 6002-6010

SUMMARY OF THE INVENTION

As described above, most of the above apparatuses have been focused on one of the reaction at the cathode and the reaction at the anode conventionally, and in the majority of cases, the reaction at the other electrode is not utilized effectively. For example, oxidation reaction of water often occurs at an anode of an electrochemical cell, and oxygen as a product of this reaction is not highly valuable in an industrial viewpoint, and results in loss of electrical energy required for a reaction at the anode.

Therefore, it is an object of the present invention to provide an electrochemical cell, an electrochemical system, and a method of producing a carbonate compound, in which valuables can be produced while reducing carbon dioxide, with combining a reaction occurring at a cathode with a reaction occurring at an anode to utilize electrical energy effectively.

As a result of intensive results, the present inventors have found that the above problem can be solved by an electrochemical cell and an electrochemical system having a certain configuration, and has accomplished the present invention described below. In other words, the present invention provides the following [1] to [3].

[1] An electrochemical cell, including: a cathode, an anode, and an ion exchange membrane disposed between the cathode and the anode, the cathode including a first catalyst capable of catalyzing a reduction reaction for reducing carbon dioxide into carbon monoxide, and the anode including a second catalyst capable of catalyzing a carbonylation reaction for producing a carbonate compound from carbon monoxide and an alcohol compound.

[2] An electrochemical system, including at least two electrochemical cells according to the above [1] as first and second electrochemical cells, wherein the electrochemical system includes a first feed path capable of feeding a product produced at a cathode of the first electrochemical cell to an anode of the second electrochemical cell.

[3] A method of producing a carbonate compound in an electrochemical cell including a cathode, an anode, and an ion exchange membrane disposed between the cathode and the anode, the method including:

a step of applying a voltage between the anode and the cathode to reduce carbon dioxide into carbon monoxide at the cathode, and to produce a carbonate compound from carbon monoxide and an alcohol compound at the anode.

DETAILED DESCRIPTION OF THE INVENTION

The present invention will be described below in a more detailed manner by embodiments.

First Embodiment

Figure 1:
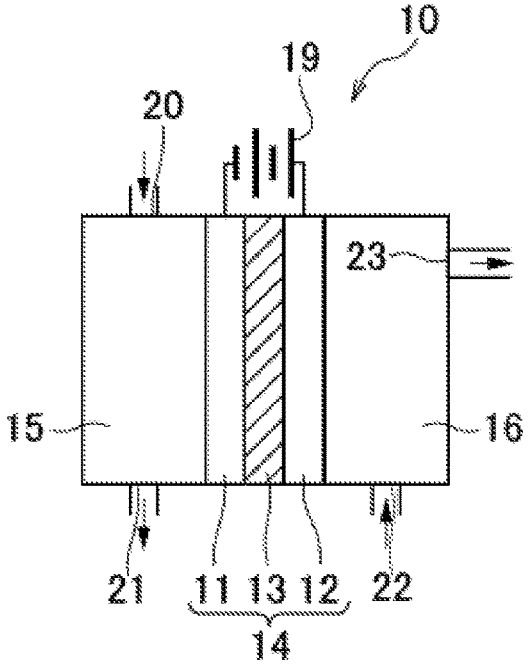
FIG. 1 is a schematic view showing an electrochemical cell according to a first embodiment of the present invention.

FIG. 1 shows an electrochemical cell according to a first embodiment of the present invention. An electrochemical cell according to the first embodiment and a method of producing a carbonate compound using the electrochemical cell will be described below with reference to FIG. 1.

An electrochemical cell 10 according to a first embodiment of the present invention includes a cathode 11, an anode 12, and an ion exchange membrane 13 disposed between the cathode 11 and the anode 12. The electrochemical cell 10 further includes a cathode compartment 15 and an anode compartment 16, and the cathode compartment 15 and the anode compartment 16 are demarcated by an ion exchange membrane 13, and a cathode 11 and an anode 12 are respectively disposed in the cathode compartment 15 and the anode compartment 16. The cathode 11 and anode 12 are connected with a power supply 19, and the power supply 19 applies a voltage between the cathode 11 and the anode 12. By applying a voltage, an electrochemical reaction occurs at the cathode 11 and the anode 12.

In the present specification, the electrochemical cell means an individual unit constituted by a set of a cathode and an anode, in which the cathode and the anode are disposed with the interposition of an ion exchange membrane, and a power supply applies a voltage between the cathode and the anode. An electrochemical cell constituted by another cathode and another anode different from the above-described cathode and anode is regarded as another electrochemical cell, and a system including two or more electrochemical cells is regarded as an electrochemical system.

The cathode 11 and the anode 12 are disposed on each surface of the ion exchange membrane 13, respectively, and the cathode 11, the anode 12 and the ion exchange membrane 13 are assembled to be a membrane-electrode assembly 14. As a result, the electrochemical cell 10 has a two compartment type cell-structure in which the cell is separated into two compartments by the membrane-electrode assembly 14, and the cathode 11 is provided on the inner surface of the cathode compartment 15, and the anode 12 is provided on the inner surface of the anode compartment 16.

In the electrochemical cell 10, a first feed port 20 and a first discharge port 21 are provided on the cathode compartment 15, and a substance introduced into the cathode compartment 15 through the first feed port 20 undergoes an electrochemical reaction at the cathode 11. The product produced at the cathode 11 can be discharged from the first discharge port 21. A second feed port 22 and a second discharge port 23 are provided on the anode compartment 16, and a substance introduced into the anode compartment 16 through the second feed port 22 undergoes an electrochemical reaction at the anode 12. The product produced at the anode 12 can be discharged from the second discharge port 23.

The cathode 11 includes a first catalyst capable of catalyzing a reduction reaction for reducing carbon dioxide into carbon monoxide (also referred to as "first reaction"). In the present embodiment, a reduction reaction for reducing carbon dioxide into carbon monoxide occurs at the cathode 11 by introducing carbon dioxide into the cathode compartment 15 through the first feed port 20. Carbon monoxide produced at the cathode 11 is discharged from the first discharge port 21. The reduction reaction occurring at the cathode 11 is specifically as shown in the following formula (i).

$$CO_2+2H^++2e^-\rightarrow CO+H_2O \quad \text{(i)}$$

The anode 12 includes a second catalyst capable of catalyzing a carbonylation reaction for producing a carbonate compound from carbon monoxide and an alcohol compound (also referred to as "second reaction"). In the present embodiment, the alcohol compound is present in the anode compartment 16, and in addition, carbon monoxide is introduced into the anode compartment 16 through the second feed port 22, and thereby, carbonate compound is produced at the anode 12 from the carbon monoxide and the alcohol compound. The carbonate compound is discharged from the second discharge port 23.

In this way, in the present embodiment, reduction of carbon dioxide is performed on the side of the cathode, and a carbonate compound is produced as valuables on the side of the anode, and as a result of these, electrical energy on the side of the anode that has not been effectively utilized in a conventional manner can be utilized in the synthesis of an industrially beneficial substance.

The first discharge port 21 provided on the cathode compartment 15 may be connected with an apparatus other than electrochemical cell 10 (also referred to as "other apparatus"). Here, examples of other apparatus include other electrochemical cell, more specifically, an anode compartment in other electrochemical cell; a reactor for performing a reaction using carbon monoxide as a source material; and a filling apparatus for filling carbon monoxide for the purpose of storage and the like, but is preferably an anode compartment of other electrochemical cell, as is stated under a second embodiment described below. Therefore, it is preferable to feed carbon monoxide produced at the cathode 11 to other apparatus via the first discharge port 21.

In other words, it is preferable that the electrochemical cell 10 does not include a connecting path connecting the cathode compartment 15 with the anode compartment 16, and enabling to output carbon monoxide in the inside of the cathode compartment 15 into the anode compartment 16, and it is preferable that carbon monoxide in the cathode compartment 15 is not fed into the anode compartment 16 in the identical electrochemical cell 10.

Each of the components in the electrochemical cell 10 and operations of these according to the present embodiment will be described below in a more detailed manner.

Cathode Compartment

Carbon dioxide is flown into the cathode compartment 15 via the first feed port 20. Carbon dioxide is flown in the form of gas. The first feed port 20 is connected with a carbon dioxide source not shown in the present figure, and carbon dioxide can be introduced from this carbon dioxide source. The first feed port 20 can be equipped with any mechanism such as a flow rate regulating mechanism to adjust flow rate of carbon dioxide to be flown into, and the like. Carbon dioxide may be continuously flown into the cathode compartment 15.

In the present embodiment, the cathode compartment 15 may not be filled with a solvent such as water and an electrolyte solution, and gaseous carbon dioxide may come into contact with cathode 11. In this regard, gaseous carbon dioxide may include moisture.

Carbon dioxide can be singly flown into the cathode compartment 15, or can also be flown into the cathode compartment 15 in the form of a mixture of carbon dioxide with an inert gas such as helium used as a carrier gas; however, carbon dioxide is preferably flown singly.

Carbon monoxide produced at the anode 11 is discharged from the discharge port 21 installed in the cathode compartment 15. In the cathode compartment 15 not subjected to filling of a liquid such as electrolyte solution, carbon monoxide may be still in the form of gas, and mixed with unreacted carbon dioxide to be discharged from the discharge port 21. Water produced as a by-product may remain in the inside of the cathode compartment 15, and then may be discharged when the amount of the water reaches a certain level. The cathode compartment 15 may be further provided with a discharge port (not shown in the present figure) for discharging water as a by-product.

Cathode

The cathode 11 reduces carbon dioxide flown into the cathode compartment 15 into carbon monoxide at the cathode 11. The cathode 11 includes a first catalyst capable of catalyzing a reduction reaction for reducing carbon dioxide into carbon monoxide (hereinafter, also referred to as "reduction catalyst"), as described above. As the reduction catalyst, for example, a variety of metal or a metal compound, or a carbon compound containing at least one of heteroelements or metals can be used.

Examples of the above metal include V, Cr, Mn, Fe, Co, Ni, Cu, Sn, Zr, Nb, Mo, Ru, Rh, Pd, Ag, Cd, Hf, Ta, W, Re, Ir, Pt, Au, Hg, Al, Si, In, Sn, Tl, Pb, Bi, Sb, Te, U, Sm, Tb, La, Ce, and Nd. Among these, preferable specific examples of the metal element include Sb, Bi, Sn, Pb, Ni, Ru, Co, Rh, Cu and Ag, and among these, Bi, Sb, Ni, Co, Ru and Ag are more preferable.

As the above metal compound, an inorganic metal compound and an organic metal compound of these metals can be each used, and specific examples include metal halides, metal oxides, metal hydroxides, metal nitrates, metal sulfates, metal acetates, metal phosphates, metal carbonyls, and metal acetyl acetonates.

Examples of the carbon compound containing at least one of the heteroelements or metals include nitrogen containing graphites, nitrogen containing carbon nanotubes, nitrogen containing graphenes, Ni and nitrogen containing graphites, Ni and nitrogen containing carbon nanotubes, Ni and nitrogen containing graphenes, Cu and nitrogen containing graphites, Cu and nitrogen containing carbon nanotubes, Cu and nitrogen containing graphenes, Co and nitrogen containing graphites, Co and nitrogen containing carbon nanotubes, and Co and nitrogen containing graphenes.

It is preferable that the cathode 11 includes an electroconductive carbon material for imparting electrical conductivity, in addition to the above reduction catalyst. In this regard, when the above carbon compound is used as a reduction catalyst, the carbon compound also functions as an electroconductive carbon material. As the electroconductive carbon material, various carbon materials having electrical conductivity can be used, and examples of these carbon materials include carbon black such as activated carbon, Ketjen black and acetylene black, graphite, carbon fiber, carbon paper, and carbon whisker.

The cathode is preferably a cathode in which at least one of the above described metals and metal compounds is supported by the electroconductive carbon material such as carbon paper. The supporting method is not limited, but for instance the metal or metal compound, which is dispersed in a solvent, may be applied onto the electroconductive carbon material such as the carbon paper, and then heated.

A fluorine-containing compound such as polytetrafluoroethylene (PTFE), tetrafluoroethylene oligomer (TFEO), graphite fluoride ((CF)n), and fluorinated pitch (FP) and a perfluoroethylene sulfonate resin can be mixed into the cathode. These fluorine-containing compounds are used as a water repellent, and improve electrochemical reaction efficiency. The above fluorine-containing compound can also be used as a binder when the cathode is formed. In this case, the cathode can be fabricated by dispersing the above reduction catalyst and the above fluorine compound in a solvent, and applying this dispersion onto an electroconductive carbon material such as carbon paper, and then heating the electroconductive carbon material.

Anode Compartment

Carbon monoxide is introduced into the anode compartment 16 through the second feed port 22 to feed anode 12 with carbon monoxide. Carbon monoxide is flown as a gas. The second feed port 22 is connected with a carbon monoxide source not shown in the present figure and carbon monoxide can be introduced into the anode compartment 16 from the carbon monoxide source. Any apparatus as the carbon monoxide source can be employed; however, the carbon monoxide source is preferably an electrochemical cell other than the electrochemical cell 10, as described below. The second feed port 22 can be equipped with any mechanism such as a flow rate regulating mechanism, and to adjust flow rate of carbon monoxide to be flown into, and the like. Carbon monoxide may be continuously flown into the cathode compartment 15. Carbon monoxide can be singly flown into the anode compartment 16, or can also be flown into the anode compartment 16 in the form of a mixture of carbon monoxide with an inert gas such as helium used as a carrier gas. An alcohol compound as a reactant described below can be introduced through the second feed port 22. The anode compartment 16 has a second discharge port 23, and the second discharge port 23 can discharge a product produced at the anode 12.

The inside of the anode compartment 16 is filled with an alcohol compound as the reactant. By way of example, the reactant can be introduced into the inside of the anode compartment 16 in advance through the second feed port 22 connected with the anode compartment 16, or can also be introduced in the inside of the anode compartment 16 in advance through a feed port different from the second feed port 22 (not shown in the present figure).

The reactant can be in the form of any of solid, liquid or gas, but is preferably in the form of gas or liquid. In the case where the reactant is in the form of solid or gas, or the case where the solubility of a third catalyst described below or the like is required to increase, the reactant filled in the anode compartment 16 as a liquid mixture of the reactant and a solvent (hereinafter, also merely referred to as "liquid mixture"). The inside of the anode compartment 16 can be fully filled with the reactant or the liquid mixture, or a part thereof may be an empty space. The reactant or the liquid mixture is subjected to bubbling, such as with carbon monoxide introduced into the anode compartment 16 through the second feed port 22.

Anode

The anode 12 includes a second catalyst for catalyzing a carbonylation reaction for producing a carbonate compound from carbon monoxide and an alcohol compound (reactant). As the second catalyst, for example, one kind of material or two or more kinds of materials selected from the group consisting of variety of metal or a metal compound and an electroconductive carbon material can be used.

The second catalyst preferably includes one or more elements of Groups 8 to 12 as the metal, and examples of the elements include iron, gold, copper, nickel, platinum, palladium, ruthenium, osmium, cobalt, rhodium, and iridium. As the metal compound, metal compounds such as inorganic metal compounds and organic metal compounds of the above metals can be used, and specific examples of these metal compounds include metal halides, metal oxides, metal hydroxides, metal nitrates, metal sulfates, metal acetates, metal phosphates, metal carbonyls, and metal acetyl acetonates, and metal halides are preferable.

As the electroconductive carbon material, various carbon materials having electrical conductivity can be used, and examples of these carbon materials include carbon black such as mesoporous carbon, activated carbon, Ketjen black and acetylene black, graphite, carbon fiber, carbon paper, and carbon whisker.

The anode 12 is a composite formed by mixing at least one of metal and a metal compound with an electroconductive carbon material. Examples of the composite include a composite film. The composite film may be formed on, for example, a substrate. The composite film can be formed by dispersing a mixture of at least one of metal and a metal compound with an electroconductive carbon material in a solvent, and applying this dispersion onto a substrate and the like, followed by heating. In this case, an electroconductive carbon material such as carbon paper may be used as the substrate.

A fluorine-containing compound such as polytetrafluoroethylene (PTFE), tetrafluoroethylene oligomer (TFEO), graphite fluoride ((CF)n), and fluorinated pitch (FP) and a perfluoroethylene sulfonate resin can be mixed into the anode 12. These compounds are used as a water repellent, and improve electrochemical reaction efficiency.

The above fluorine-containing compound can also be used as a binder when the cathode is formed. Therefore, when the above described composite is formed, the fluorine-containing compound may be further mixed with at least one of the metal and the metal compound, and the electroconductive carbon material.

Reactant (Alcohol Compound)

Examples of the alcohol compound used as the reactant in the present invention include monoalcohol compounds and polyol compounds such as diol compound, and more specifically, the reactant preferably includes at least one compound represented by the following general formula (1). In the present specification, the term "alcohol compound" encompasses, a compound in which a hydroxyl group is directly attached to an aromatic ring such as phenols.

$$R^1OH \quad (1)$$

($R^1$ represents an organic group having 1 to 15 carbon atoms.)

When the reactant is a compound represented by general formula (1), for example, carbonylation reaction as shown in the following formula (ii) occurs at the anode 12.

$$CO+2R^1OH \rightarrow CO(OR^1)_2+2H^++2e^- \quad (ii)$$

Examples of the organic group having 1 to 15 carbon atoms represented by Win the above general formula (1) include a hydrocarbon group having 1 to 15 carbon atoms. As the hydrocarbon group, an alkyl group having 1 to 15 carbon atoms, an alkenyl group having 2 to 15 carbon atoms, and an aryl group having 6 to 15 carbon atoms are preferable.

Examples of the alkyl group having 1 to 15 carbon atoms include a methyl group, an ethyl group, various propyl groups, various butyl groups, various pentyl groups, various hexyl groups, various heptyl groups, various octyl groups, various nonyl groups, various decyl groups, various dodecyl groups, and various pentadecyl groups.

Examples of the alkenyl group having 2 to 15 carbon atoms include a vinyl group, various propynyl groups, various butynyl groups, various penthynyl groups, various hexenyl groups, various heptenyl groups, various octenyl groups, various nonenyl groups, various decenyl groups, various dodecenyl groups, and various pentadecenyl groups.

"Various" means various isomers including isomers of n-, sec-, tert- and iso-types. Alkyl group or alkenyl group can be linear, branched or cyclic.

Examples of the aryl group having 6 to 15 carbon atoms include phenyl groups, and naphthyl groups.

The above-described hydrocarbon group can include a substituent, and in this case, the number of carbon atoms including carbon atoms in the substituent is 1 to 15.

The organic group having 1 to 15 carbon atoms in the general formula (1) can contain a heteroatom such as a nitrogen atom, an oxygen atom, a sulfur atom, a halogen atom and a phosphorus atom.

Among these, an oxygen atom is preferable. When the above organic group includes an oxygen atom, the oxygen atom is preferably included in a hydroxyl group or an ether bond. Therefore, $R^1$ is preferably a hydrocarbon group including at least one of a hydroxyl group and an ether bond. It is preferable that a single hydroxyl group is in $R^1$. When $R^1$ is an organic group having a hydroxyl group, it is preferable that a reaction according to the formula (iii) described below proceeds, and when $R^1$ does not have a hydroxyl group, it is preferable that a reaction according to the above formula (ii) or the formula (iv) described below proceeds.

A halogen atom is also preferable as the heteroatom. For example, the above-described alkyl group, alkenyl group or aryl group can be substituted with one halogen atom or two or more halogen atoms. Examples of the halogen atom include a chlorine atom, a fluorine atom, a bromine atom, and an iodine atom.

When the above $R^1$ contains a hydroxyl group, $R^1OH$ is represented by $HOR^{11}OH$, and a carbonylation reaction according to the following formula (iii) may occur to produce a cyclic carbonate compound at the anode.

(iii)

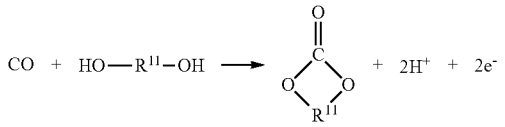

wherein $R^{11}$ is an organic group having 1 to 15 carbon atoms. Examples of the organic group include a hydrocarbon group having 1 to 15 carbon atoms. The hydrocarbon group can be an aliphatic hydrocarbon group, or an aromatic hydrocarbon group. The aliphatic hydrocarbon group may be saturated or unsaturated, but is preferably a saturated aliphatic hydrocarbon group. The organic group having 1 to 15 carbon atoms in $R^{11}$ can contain a heteroatom such as a nitrogen atom, an oxygen atom, a sulfur atom, a halogen atom and a phosphorus atom. Among these, an oxygen atom is preferable. A halogen atom is also preferable. When the organic group includes an oxygen atom, the oxygen atom is preferably included in an ether bond. $R^{11}$ preferably has 2 to 8 carbon atoms. $R^{11}$ can be substituted with one halogen atom such as a chlorine atom or 2 or more halogen atoms.

More specifically, $R^1$ having a hydroxyl group (in other words, $R^1$ is $R^{11}OH$) is preferably a hydroxyalkyl group having 2 to 15 carbon atoms, or a group represented by the following formula (2). Among these, a hydroxyalkyl group having 2 to 15 carbon atoms is more preferable.

$$H^-(OR)_m^- \quad (2)$$

In the formula (2), R is a divalent saturated hydrocarbon group having 2 to 4 carbon atoms, and m is an integer of 2 to 7. Examples of OR in the formula (2) include an oxyethylene group, an oxypropylene group, and an oxybutylene group.

In the hydroxyalkyl group as $R^1$, at least one of hydrogen atoms in the alkyl group may be substituted with a halogen atom.

Among the alcohol compounds described above, preference is given to an alcohol compound in which $R^1$ is a hydrocarbon group having 1 to 8 carbon atoms such as an alkyl group having 1 to 8 carbon atoms, an alkenyl group having 2 to 8 carbon atoms and an aryl group having 6 to 8 carbon atoms, or a hydrocarbon group including a hydroxyl group having 2 to 8 carbon atoms such as a hydroxyalkyl group having 2 to 8 carbon atoms. As specific alcohol compounds, preference is given to methanol, ethanol, phenol, 1-propanol, 1-butanol, 1-pentanol, 1-hexanol, 1-octanol, 2-propanol, 2-butanol, 2-pentanol, 2-hexanol, 2-octanol, tert-butyl alcohol, ethylene glycol, propylene glycol (1,2-propanediol), 1,3-propanediol, 1,2-butanediol, ethene-1,2-diol, 2-butene-2,3-diol, glycerol, and the like.

It is also preferable that the hydrocarbon group having 1 to 8 carbon atoms such as an alkyl group having 1 to 8 carbon atoms, an alkenyl group having 2 to 8 carbon atoms and an aryl group having 6 to 8 carbon atoms, and the hydrocarbon group including a hydroxyl group having 2 to 8 carbon atoms such as a hydroxyalkyl group having 2 to 8 carbon atoms are substituted with one halogen atom or two or more halogen atoms, such as chlorine atom(s). In this case, as specific examples of the alcohol compound, preference is also given to 2-chloroethanol, trichloromethanol, 2,2,2-trifluoroethanol, 4-chlorophenol, 1-chloroethane-1,2-diol, 1-fluoroethane-1,2-diol, and the like. Among these, a compound in which $R^1$ is an alkyl group or an aryl group is particularly preferable. When $R^1$ is a hydroxyalkyl group, this means that $R^1$ is $R^{11}OH$.

More preferable specific examples of the alcohol compound include methanol, ethanol, phenol, 1-propanol, 1-butanol, ethylene glycol, 1,2-propanediol, 1,3-propanediol, 1,2-butanediol, and trichloromethanol.

A kind of the reactant can be used singly, or two kinds or more of the reactants can be used in combination. When two or more kinds of the reactants are used in combination, a carbonylation reaction represented by the following formula (iv) occurs.

$$CO+R^2OH+R^3OH \rightarrow (R^2O)CO(OR^3)+2H^++2e^- \quad (iv)$$

$R^2$ and $R^3$ have the same meaning as the above-described $R^1$; however, $R^2$ and $R^3$ are groups different from each other. In other words, both $R^2$ and $R^3$ represent an organic group having 1 to 15 carbon atoms, while $R^2$ and $R^3$ are groups different from each other. The detailed description regarding $R^2$ and $R^3$ is same as in the above-described $R^1$.

As described above, when the compound represented by the formula (1) is used to generate a the carbonylation reaction represented by formula (ii) or the formula (iii), the final product may include at least one compound represented by the following general formula (3) and (4):

(3)

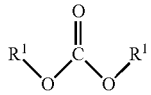

(4)

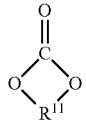

wherein $R^1$ and $R^{11}$ are as defined above.

More specifically, examples of the final product resulted from the carbonylation reaction include one of or two or more of dimethyl carbonate, diethyl carbonate, dipropyl carbonate, dibutyl carbonate, dipentyl carbonate, dihexyl carbonate, dioctyl carbonate, diphenyl carbonate, triphosgene, bis(2-chloroethyl) carbonate, bis(4-chlorophenyl) carbonate, bis(2,2,2-trifluoroethyl) carbonate, ethylene carbonate, propylene carbonate, trimethylene carbonate (1,3-dioxan-2-one), 1,2-butylene carbonate, 4,5-dimethyl-1,3-dioxol-2-one, vinylene carbonate, 4-chloro-1,3-dioxolan-2-one, 4-fluoro-1,3-dioxolan-2-one, and glycerol-1,2-carbonate.

When the reaction according to the formula (iv) occurs, the final product may include at least one compound represented by the following general formula (5):

(5)

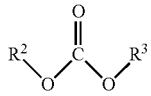

wherein $R^2$ and $R^3$ are as defined above.

Examples of the final product according to the reaction represented by the formula (iv) include one of or two or more of ethyl methyl carbonate, methyl propyl carbonate, chloromethyl isopropyl carbonate, methyl phenyl carbonate, ethyl phenyl carbonate, ethyl propyl carbonate, and butyl methyl carbonate.

Among the carbonate compounds described above, particular preference for the produced carbonate compound is given to one compound or two or more compounds selected form dimethyl carbonate, diethyl carbonate, dipropyl carbonate, dibutyl carbonate, diphenyl carbonate, ethylene carbonate, propylene carbonate, 1,2-butylene carbonate, 1,3-dioxan-2-one, triphosgene, ethyl methyl carbonate, methyl phenyl carbonate, and butyl methyl carbonate.

Solvent

As the solvent that can be used together with reactant in the anode compartment 16, it is possible to select a solvent typically used in a electrochemical reaction, and examples of such a solvent include nitrile based solvents such as acetonitrile; carbonate ester based solvents such as ethylene carbonate, propylene carbonate, butylene carbonate, vinylene carbonate, dimethyl carbonate, ethyl methyl carbonate and diethyl carbonate; lactone based solvents such as γ-butyrolactone; ether based solvents such as 1,2-dimethoxyethane, 1-ethoxy-2-methoxyethane, 1,2-diethoxyethane, tetrahydrofurane and 2-methyltetrahydrofurane; phosphate ester solvents; phosphoric acids; sulfolane based solvents; and pyrrolidones. One of these solvents can be singly used, or two or more of these solvents can be used in combination.

Electrolyte Salt

In anode compartment 16, it is preferable that an electrolyte salt is added to the reactant or the liquid mixture in the form of liquid, in view of improvement in electrochemical reaction efficiency. In this case, the reactant or the liquid mixture itself functions as an electrolyte solution. Examples of the electrolyte salt include alkali metal salts, peroxides of alkali metal, and ammonium salts.

Specifically, examples of the alkali metal salt include lithium salts such as lithium hydroxide, lithium chloride, lithium bromide, lithium iodide, lithium hydrogen carbonate, lithium sulfate, lithium hydrogen sulfate, lithium phosphate and lithium hydrogen phosphate; sodium salts such as sodium hydroxide, sodium chloride, sodium bromide, sodium iodide, sodium hydrogen carbonate, sodium sulfate, sodium hydrogen sulfate, sodium phosphate and sodium hydrogen phosphate; and potassium salts such as potassium hydroxide, potassium chloride, potassium bromide, potassium iodide, potassium hydrogen carbonate, potassium sulfate, potassium hydrogen sulfate, potassium phosphate, potassium hydrogen phosphate.

Examples of the peroxides of alkali metal include lithium peroxide, and sodium peroxide.

Examples of the ammonium salt include ammonium chloride, ammonium bromide, ammonium iodide, ammonium perchlorate, and tetrabutylammonium tetrafluoroborate.

One of these electrolyte salts can be used singly, or two or more of these electrolyte salts can be used in combination.

The concentration of the electrolyte salt in the solution is, for example, in a range of 0.001 to 2 mol/L, and preferably 0.01 to 1 mol/L.

Third Catalyst

The electrochemical cell 10 may include a third catalyst capable of catalyzing a reaction between carbon monoxide and the reactant (second reaction). The third catalyst is preferably included in the reactant or the liquid mixture of the reactant and the solvent filled in the anode compartment 16. The third catalyst may be contained in the anode 12, by being supported by the second electrode, or by the like.

The third catalyst is preferably a redox catalyst. The redox catalyst in the present specification can be any compound as long as the compound can reversibly change its oxidation state, and examples of such a compound include metal compounds containing at least one active metal, organic compounds, and halogens. The redox catalyst exhibits oxidation-reduction characteristics, and therefore, catalyzes the second reaction between carbon monoxide and the reactant in regions except for the vicinity of anode, and the redox catalyst itself is reduced. Here, the reduced redox catalyst is oxidized again by the electrochemical reaction on the anode 12, and the oxidized catalyst can catalyze the second reaction between carbon monoxide and the reactant again.

The reactant filled in the anode compartment 16 typically reacts with carbon monoxide present in the reactant or a liquid mixture of the reactant and the solvent on the anode 12 (second reaction). Here, as for the second reaction, when the volume of the reactant is large, the diffusion of the reactant in the vicinity of the anode ordinarily becomes a rate-determining step of the second reaction, and the overall reaction rate becomes slow. However, when the redox catalyst is contained, the material which diffuses on the anode becomes only the redox catalyst, and accordingly a reaction rate of the second reaction in the anode compartment 16 can be improved. In addition, restrictions on the physical properties of the reactant are relaxed, and accordingly, it becomes possible to use various reactants.

Examples of the active metal included in the redox catalyst include V, Cr, Mn, Fe, Co, Ni, Cu, Sn, Zr, Nb, Mo, Ru, Rh, Pd, Ag, Cd, Hf, Ta, W, Re, Ir, Pt, Au, Hg, Al, Si, In, Sn, Tl, Pb, Bi, Sb, Te, U, Sm, Tb, La, Ce, and Nd. Among these, Pd, Co, and Ni are preferable.

As the metal compounds containing the active metal, inorganic metal compounds and organic metal compounds of the above metals can be used, and the examples thereof include a metal halide, a metal oxide, a metal hydroxide, a metal nitrate, a metal sulfate, a metal acetate, a metal phosphate, a metal carbonyl, and metal organic complexes such as a metal acetylacetonate.

Specific examples of the metal compounds containing the active metal include palladium acetylacetonate ($Pd(OAc)_2$), tetrakis(triphenylphosphine)palladium ($Pd(PPh_3)_4$ complex), tris(2,2'-bipyridine)cobalt ($Co(bpy)_3$ complex), and tris[1,3-bis(4-pyridyl)propane)]cobalt ($Co(bpp)_3$ complex).

The organic compounds which are used in the redox catalyst include 2,2,6,6-tetramethylpiperidine 1-oxyl (TEMPO).

The halogens which are used in the redox catalyst include bromine and iodine.

The third catalysts may be used each alone, or two or more of the catalysts may be used in combination.

The concentration of the third catalyst in the solution filled in the anode compartment is, for example, in a range of 0.001 to 2 mol/L, and preferably is in a range of 0.001 to 1 mol/L.

The final product (carbonate compound) produced by the above second reaction may be discharged from the second discharge port 23. Usually, the unreacted reactant, the solvent, and the like are also discharged together with the final product from the second discharge port 23. The discharge of the final product from the second discharge port 23 is not limited in particular; however, by way of example, the discharge of the final product may be performed after a certain amount of the final product is produced in the inside of the anode compartment 16. The final product discharged from the second discharge port 23 may be purified, where appropriate. The unreacted reactant, the solvent, and the like discharged together with the final product can be introduced again through the second feed port 22, or can also be introduced through other feed port. Therefore, the electrochemical cell 10 of the present embodiment can be equipped with a separation mechanism for separating the reactant from the final product, a circulation mechanism for circulating the reactant, and the like.

In addition, the anode compartment 16 can be further equipped with a discharge port (not shown in the present figure) for discharging carbon monoxide fed in the anode compartment 16 at an excessive amount.

Ion Exchange Membrane

A solid membrane is used as the ion exchange membrane 13, and examples thereof include a cation exchange membrane that can transport cations such as protons, and an anion exchange membrane that can transport anions. In the present embodiment, cations such as protons generate at the anode 12, and the cations are supplied to the side of the cathode 11 through the ion exchange membrane 13, as described above.

Preferable examples of the cation exchange membrane include hydrocarbon resin-based polysulfonic acids and carboxylic acids such as polyethylene sulfonic acid, fullerene-crosslinked polysulfonic acid and polyacrylic acids; and fluororesin-based sulfonic acids and carboxylic acids such as perfluoroethylene sulfonic acid. Phosphate glasses such as $SiO_2$—$P_2O_5$, heteropoly acids such as tungstosilicic acid and tungstophosphoric acid, ceramics such as perovskite type oxides, and the like can be also used.

Preferable examples of the anion exchange membrane include resins such as those including a quaternary ammonium salt such as poly(styrylmethyltrimethylammoniumchloride), and polyethers.

Among the cation exchange membranes described above, preference is given to perfluoroethylene sulfonate resins. Examples of commercially available products of the perfluoroethylene sulfonate resin include Nafion (trade name possessed by Du Pont).

Second Embodiment

Next, a method of producing a carbonate compound using an electrochemical system and an electrochemical system according to a second embodiment of the present invention will be described. In a second embodiment, an electrochemical system including at least two electrochemical cells is used. The electrochemical system 25 in the present embodiment includes two electrochemical cells (first and second electrochemical cells 10A and 10B). Each of the first and second electrochemical cells 10A and 10B has the same configuration as in the electrochemical cell 10 of the first embodiment described above, and therefore, the descriptions regarding the configurations of these electrochemical cells 10A and 10B are omitted; however, any of the first and second electrochemical cells 10A and 10B includes a set of a cathode and an anode with an ion exchange membrane being disposed between the cathode and the anode. The ion exchange membranes in the electrochemical cell 10A and 10B are discrete each other.

In the following description, the reference numeral regarding each component in the first electrochemical cell 10A is represented by postfixing the reference numeral that follows the name of each component in the electrochemical cell 10 of the first embodiment with "A", and the reference numeral regarding each component in the second electrochemical cell 10B is represented by postfixing the reference numeral regarding each component in the above electrochemical cell with "B". Therefore, by way of example, the cathode of the first electrochemical cell 10A is represented by reference numeral "11A", and the cathode of the second electrochemical cell 10B is represented by reference numeral "11B".

An electrochemical system 25 in the present embodiment includes first and second feed paths 26 and 27, in addition to the first and second electrochemical cells 10A and 10B. The first feed path 26 connects a cathode compartment 15A in the first electrochemical cell 10A with an anode compartment 16B in the second electrochemical cell 10B. The second feed path 27 connects an anode compartment 16A in the first electrochemical cell 10A with the cathode compartment 15B in the second electrochemical cell 10B. The first and second feed paths 26 and 27 connects a first discharge port 21A with a second feed port 22B, and a first discharge port 21B with second feed port 22A, respectively. The first feed path 26 can feed the product produced at the cathode 11A in the first electrochemical cell 10A to the anode 12B in the second electrochemical cell. The second feed path 27 can feed the product produced at the cathode 11B in the second electrochemical cell 10B to the anode 12A in first electrochemical cell.

The first and second feed paths 26 and 27 are, for example, conducting pipes for connecting the cathode compartment with the anode compartment, and the like, and can be equipped with, for example, a flow rate regulating mechanism to adjust the flow rate and the like. The conducting pipe is equipped with a backflow preventing mechanism such as a non-return valve to allow for the delivery of a gas from each of the cathode compartments 15A and 15B to each of the anode compartments 16B and 16A, and not to allow for the delivery of the gas in the backward direction.

The first feeds path 26 feeds carbon monoxide produced at the cathode 11A in the first electrochemical cell 10A to the anode 12B in the second electrochemical cell 10B. The second feed path 27 feeds carbon monoxide produced at the cathode 11B in second electrochemical cell 10B to the anode 12A in the first electrochemical cell 10B. Carbon monoxide produced at the respective cathodes 11A and 11B may be fed in the form of gas to the anodes 12B and 12A of the respective anode compartments 16B and 16A. Carbon monoxide produced at the respective cathodes 11A and 11B can be mixed with unreacted carbon dioxide in the respective cathode compartments 15A and 15B to be fed to the respective anodes through the first and second feed paths 26 and 27.

At each of the anodes 12B and 12A, carbonate compound is produced from the alcohol compounds filled in each of the anode compartments 16B and 16A, and carbon monoxide fed from on the side of the cathodes 11A and 11B.

Due to the fact that the electrochemical system 25 has the above-described configuration, the electrochemical system 25 performs the reduction of carbon dioxide on the side of the cathode, and produces a carbonate compound as valuables on the side of the anode, and as a result of these, the electrical energy on the side of the anode can be utilized in the synthesis of an industrially beneficial substance. In the present embodiment, as a result of combining two electrochemical cells to supply carbon monoxide in each of the electrochemical cells to another electrochemical cell, a valuable chemical substance can be efficiently produced at the anode of each of the electrochemical cells without installation of another carbon monoxide source.

Figure 2:
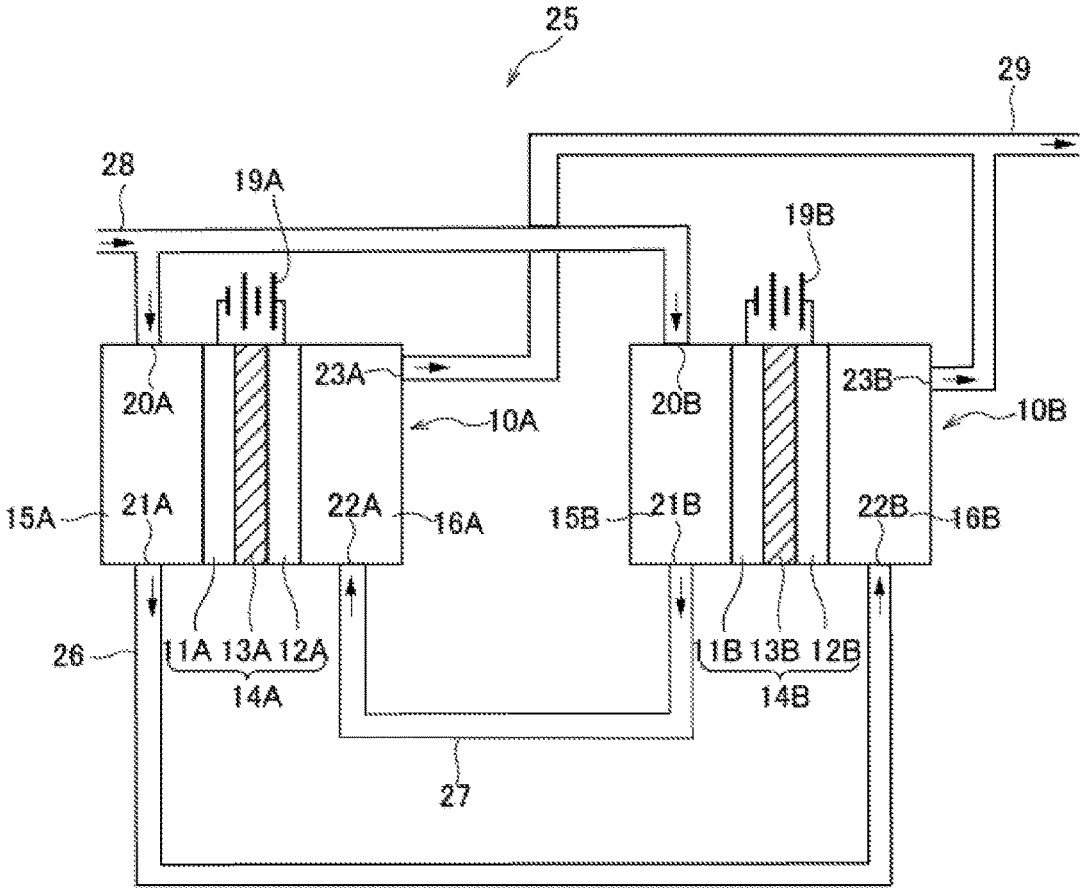
FIG. 2 is a schematic view showing an electrochemical system according to a second embodiment of the present invention.

In the second embodiment, carbon dioxide is fed to each of the electrochemical cells 10A and 10B through first feed ports 20A and 20B via, for example, carbon dioxide feed path 28. As shown in FIG. 2, with regard to the carbon dioxide feed path 28, a single feed path can be divided into two feed path to be connected with each of the feed ports 20A and 20B; however, carbon dioxide can also be fed to each of the feed ports 20A and 20B from separate feed paths. Likewise, the carbonate compound is discharged through each of the discharge ports 23A and 23B with passing a product discharge path 29; however, as shown in FIG. 2, the carbonate compound can be discharged with passing a product discharge path 29 in which two discharge paths join together to become a single discharge path, but two discharge path do not have to join together.

In the second embodiment, the second feed path 27 can be eliminated. Also in the case where the second feed path 27 is eliminated, a carbonate compound can be produced not only at the anode 12B of the second electrochemical cell 10B, but also at the anode 12A of the first electrochemical cell 10A by feeding carbon monoxide to the anode 12A via the second feed port 22A from another carbon monoxide source with regard to the anode 12A of the first electrochemical cell 10A.

Third Embodiment

Next, a third embodiment of the present invention will be described. The third embodiment provides an electrochemical system including at least three electrochemical cells. An electrochemical system 30 according to the present embodiment includes three electrochemical cells (first, second and third electrochemical cells 10A, 10B and 10C). Each of the first, second and third electrochemical cells 10A, 10B and 10C has the same configuration as in the first electrochemical cell 10 described above, and therefore, the descriptions regarding the configurations of these electrochemical cells 10A, 10B and 10C are omitted; however, any of the first, second and third electrochemical cells 10A, 10B and 10C includes a set of a cathode and an anode with an ion exchange membrane being disposed between the cathode and the anode. The ion exchange membranes in the electrochemical cells 10A, 10B and 10C are discrete one another.

In the following description, the reference numeral regarding each component in the first electrochemical cell 10A is represented by postfixing the reference numeral regarding each component in the above electrochemical cell 10 with "A", and the reference numeral regarding each component in the second electrochemical cell 10B is represented by postfixing the reference numeral regarding each component in the above electrochemical cell 10 with "B", and the reference numeral regarding each component in the third electrochemical cell 10C is represented by postfixing the reference numeral regarding each component in the above electrochemical cell 10 with "C". Therefore, by way of example, the cathode of the first electrochemical cell 10A is represented by reference numeral "11A", the cathode of the second electrochemical cell 10B is represented by reference numeral "11B", and the cathode of the third electrochemical cell 10C is represented by reference numeral "11C".

An electrochemical system 30 in the present embodiment includes first, second and third feed paths 31, 32 and 33, in addition to the first, second and third electrochemical cells 10A, 10B and 10C. The first feed path 31 connects the cathode compartment 15A in the first electrochemical cell 10A with the anode compartment 16B in the second electrochemical cell 10B. The second feed path 32 connects the cathode compartment 15B in the second electrochemical cell 10B with the anode compartment 16C in the third electrochemical cell 10C. The third feed path 33 connects the cathode compartment 15C in the third electrochemical cell 10C with the anode compartment 16A in the first electrochemical cell 10A.

The first, second, and second feed paths 31, 32 and 33 connects a first discharge port 21A with a second feed port 22B, a first discharge port 21B with a second feed port 22C, and a first discharge port 21C with a second feed port 22A, respectively.

The first, second and third feed paths 31, 32 and 33 can feed the products produced at the cathode 11A, 11B and 11C to anodes 12B, 12C and 12A, respectively.

The first, second and third feed paths 31, 32 and 33 are, for example, conducting pipes for connecting the cathode compartment with the anode compartment, and may be equipped with, for example, a flow rate regulating mechanism to adjust the flow rate and the like. The conducting pipe is equipped with a backflow preventing mechanism such as a non-return valve to allow for the delivery of a gas from each of the cathode compartments 15A, 15B and 15C to each of the anode compartments 16B, 16C and 15A, and not to allow for the delivery of the gas in the backward direction.

The first feed path 31 feeds carbon monoxide produced at the cathode 11A in the first electrochemical cell 10A to the anode 12B in the second electrochemical cell 10B. The second feed path 32 feeds carbon monoxide produced at the cathode 11B in the second electrochemical cell 10B to the anode 12C in the third electrochemical cell 10C. The third feed path 33 feeds carbon monoxide produced at the cathode 11C in the third electrochemical cell 10C to the anode 12A in the first electrochemical cell 10A.

Carbon monoxide produced at the respective cathodes 11A, 11B and 11C may be fed in the form of gas to the anodes 12B, 12B and 12C of the respective anode compartments 16B, 16C and 16A.

Carbon monoxide produced at the respective cathodes 11A, 11B and 11C can be mixed with unreacted carbon dioxide in the respective cathode compartments 15A, 15B and 15C to be fed to the respective anode compartments 16B, 16C and 16A through the first, second and third feed paths 31, 32 and 33.

At the anodes 12B, 12C and 12A, a carbonate compound is produced from the alcohol compounds filled in the anode compartments 16B, 16C and 16A, and carbon monoxide fed from the side of the cathodes 11A, 11B and 11C, respectively.

As a result of the fact that the electrochemical system 30 has the above-described configuration, the electrochemical system 30 perform the reduction of carbon dioxide on the side of the cathode, and produces a carbonate compound as valuables on the side of the anode, and therefore, the electrical energy on the side of the anode can be utilized in the synthesis of an industrially beneficial substance. In the present embodiment, as a result of combining three electrochemical cells to supply carbon monoxide in each of the electrochemical cells to another electrochemical cell, a beneficial chemical substance can be efficiently produced at the anode of each of the electrochemical cells without installation of another carbon monoxide source.

In the third embodiment described above, the third feed path 33 can be eliminated. In the case where the third feed path is eliminated, carbon monoxide from another carbon monoxide source may be fed to the anode compartment 16A of the first electrochemical cell 10A appropriately.

Figure 3:
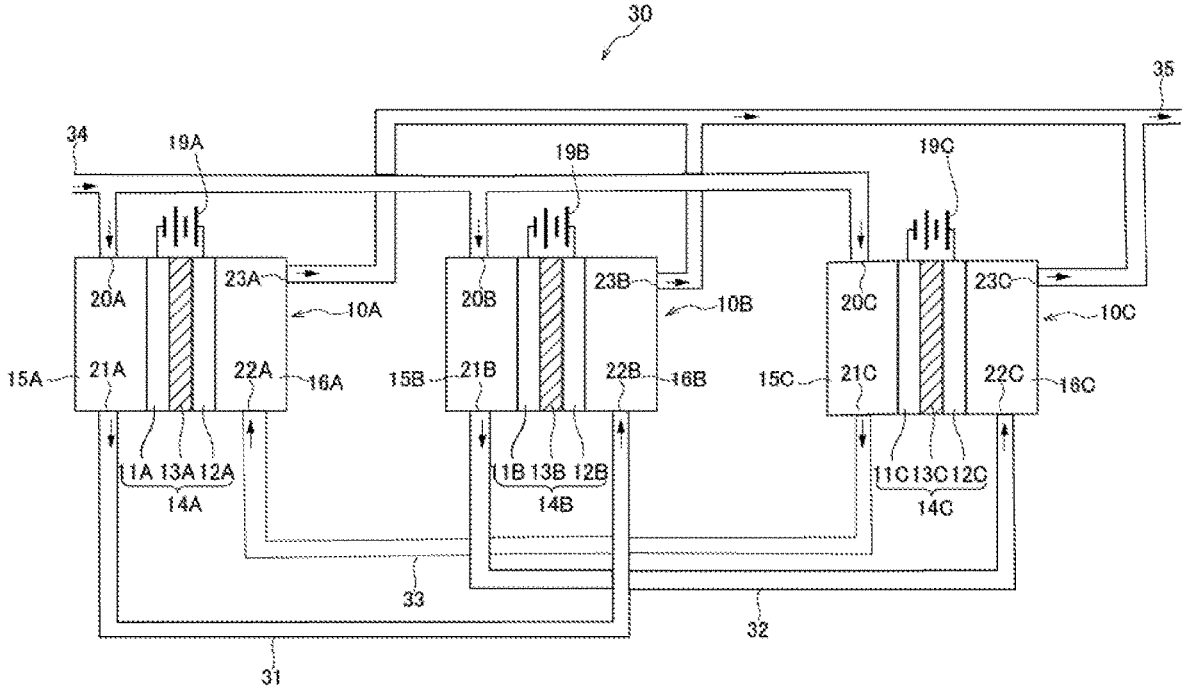
FIG. 3 is a schematic view showing an electrochemical system according to a third embodiment of the present invention.

Also in the third embodiment, carbon dioxide is fed to each of the electrochemical cells 10A, 10B and 10C via, for example, carbon dioxide feed path 34 in a manner analogous to as in the second embodiment, and as shown in FIG. 3, with regard to the carbon dioxide feed path 34, a single feed path can be divided into three feed paths to be connected with each of the feed ports 20A, 20B and 20C, or can be connected with separate feed paths. Likewise, with regard to the product discharge path 35 for discharging the carbonate compound, three discharge paths can join together to become a single discharge path as shown in FIG. 3; however, these discharge paths do not have to join together.

The electrochemical system 30 according to the third embodiment described above includes three electrochemical cells, but may include four or more electrochemical cells. When the electrochemical system 30 according to the third embodiment includes four or more electrochemical cells, the electrochemical system includes first, second, . . . , and nth electrochemical cells (here, n is an integer of 4 or more), and the cathode compartments of the first, second, . . . , and (n-1)th electrochemical cell may be respectively connected with the anode compartment of the second, third, . . . , and nth electrochemical cell via the respective first, second, . . . , (n-1)th feed paths. The first, second, . . . , and (n-1)th feed paths can feed the products (carbon monoxide) produced at the respective cathodes in the first, second, . . . , (n-1)th electrochemical cell to the respective anodes in the second, third, . . . , and nth electrochemical cells.

The cathode compartment in the nth electrochemical cell may be connected with the anode compartment in the first electrochemical cell via an nth feed path. The nth feed path can feed the products (carbon monoxide) produced at the cathode in the nth electrochemical cell to the anode in the first electrochemical cell. In this regard, the nth feed path may be eliminated, and carbon monoxide from another carbon monoxide source may be fed to the anode compartment of the first electrochemical cell, where appropriate.

In this way, even when the electrochemical system 30 according to the third embodiment includes four or more electrochemical cells, as a result of connecting the electrochemical cells with one another by the feed paths, a beneficial chemical substance can be efficiently produced at the anode of each of the electrochemical cells without installation of another carbon monoxide source.

Fourth Embodiment

Figure 4:
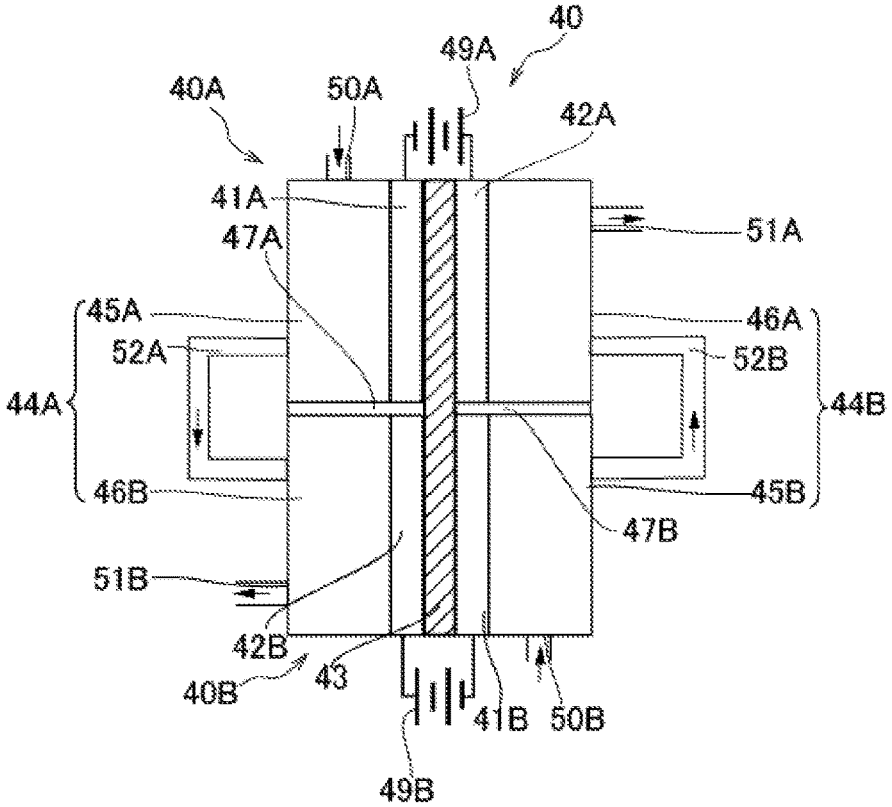
FIG. 4 is a schematic view showing an electrochemical cell according to a fourth embodiment of the present invention.

Next, an electrochemical system according to a fourth embodiment will be described with reference to FIG. 4. In a manner analogous to the above second embodiment, an electrochemical system 40 according to the present embodiment includes two electrochemical cells (first and second electrochemical cells 40A and 40B). The cathode and the anode constituting each of the electrochemical cells in the above second embodiment are disposed in each of the electrochemical cells so as to be separated by a discrete ion exchange membrane; however, in the electrochemical system 40 according to the present embodiment, both of a cathode and an anode constituting each of electrochemical cells 40A and 40B are separated by an ion exchange membrane 43 as an identical ion exchange membrane. In other words, the electrochemical system 40 of the present embodiment includes two sets of cathodes and anodes with the interposition of a single ion exchange membrane.

In the following description, a cathode and an anode constituting a first electrochemical cell 40A are described as first cathode 41A and first anode 42A, and a cathode and an anode constituting a second electrochemical cell 40B are described as second cathode 41B and second anode 42B. Likewise, a cathode compartment and an anode compartment included in the first electrochemical cell 40A are described as first cathode compartment 45A and first anode compartment 46A, and a cathode compartment and an anode compartment constituting the second electrochemical cell 40B are described as second cathode compartment 45B and second anode compartment 46B.

The cathode and the anode of the first electrochemical cell 40A (in other words, the first cathode 41A and the first anode 42A), as well as the cathode and the anode of the second electrochemical cell 40B (in other words, the second cathode 41B and the second anode 42B) are separated by an ion exchange membrane 43, and are disposed so as to be opposed to one another with the interposition of the ion exchange membrane 43.

The first cathode 41A and the second anode 42B are located in one section 44A separated by the ion exchange membrane 43, and the first anode 42A and the second cathode 41B are located in the other section 44B separated by the ion exchange membrane 43.

The one section 44A is further partitioned into two sections by a first partition wall 47A, and these two sections respectively constitutes a first cathode compartment 45A and a second anode compartment 46B. A first cathode 41A and second cathode 42B are disposed in the first cathode compartment 45A and the second anode compartment 46B, respectively.

Likewise, the other section 44B is further partitioned into two sections by a second partition wall 47B, and these two sections constitute a first anode compartment 46A and a second cathode compartment 45B, respectively. The first anode 42A and the second cathode 41B are disposed in the first anode compartment 46A and second cathode compartment 45B, respectively.

The first and second partition walls 47A and 47B are not limited in particular as long as these partition walls 47A and 47B are insulators, and as the insulator, resin materials and the like can be used. Examples of the resin materials include fluororesins such as polytetrafluoroethylene (PTFE), silicone resins, ABS resins, PLA resins, epoxy resins, ionomer resins, carbonate resins, urethane resins, fluoro rubbers, and butyl rubbers.

The cathode and the anode constituting each of the electrochemical cells are connected with power supply. In other words, the first cathode 41A and the first anode 42A are connected with a first power supply 49A, and the first power supply 49A applies a voltage between the first cathode 41A and the first anode 42A. Likewise, the second cathode 41B and the second anode 42B are connected with a second power supply 49B, and the second power supply 49B applies a voltage between the second cathode 41B and the second anode 42B.

As a result, donation and reception of electrons occur between the first cathode 41A and the first anode 42A, and by way of example, cations produced at the first anode 42A are supplied to the first cathode 41A through the ion exchange membrane 43. Also, donation and reception of electrons occur between the second cathode 41B and the first anode 42B, and by way of example, cations produced at the second anode 42B are supplied to the second cathode 41B through the ion exchange membrane 43.

The first and second cathode compartments 45A and 45B are respectively equipped with first and second feed ports 50A and 50B, and the first and second anode compartments 46A and 46B are respectively equipped with first and second discharge ports 51A and 51B. The electrochemical cell 40 includes a first feed path 52A and a second feed path 52B. The first feed path 52A connects the first cathode compartment 45A with the second anode compartment 46B, in which these compartments 45A and 46B are disposed on the side of one section 44A. The second feed path 52B connects the second cathode compartment 45B with the first anode compartment 46A, in which these compartments 45B and 46A are deposed on the side of the other section 44B.

The first and second feed paths 52A and 52B are, for example, conducting pipes connecting the cathode compartment with the anode compartment, and may be equipped with, for example, a flow rate regulating mechanism to adjust the flow rate and the like. The conducting pipe is equipped with a backflow preventing mechanism such as a non-return valve to allow for the delivery of a gas from each of the cathode compartments 45A and 45B to each of the anode compartments 46A and 46B, and not to allow for the delivery of the gas in the backward direction.

Both of the first and second cathodes 41A and 41B include a first catalyst capable of catalyzing a reduction reaction for reducing carbon dioxide into carbon monoxide (first reaction). Also in the present embodiment, as a result of the fact that carbon dioxide is introduced in the first and second cathode compartments 45A and 45B through the first and second feed ports 50A and 50B, a reduction reaction for reducing carbon dioxide into carbon monoxide (first reaction) occurs at the cathodes 41A and 41B. The product produced at each of the first and second cathodes 41A and 41B (in other words, carbon monoxide) are fed to the second and first anodes 42B and 42A in the second and first anode compartments 46B and 46A via first and second feed paths 52A and 52B.

The second and first anodes 42B and 42A include second catalysts capable of catalyzing a carbonylation reaction for producing a carbonate compound from carbon monoxide and an alcohol compound (second reaction). In the present embodiment, as a result of the fact that the alcohol compounds are present in each of the anode compartments 46A and 46B, and in addition, carbon monoxide is introduced in the anode compartments 46A and 46B from the second and first feed paths 52B and 52A, a carbonylation reaction for producing a carbonate compound from carbon monoxide and the alcohol compound occurs at each of the first and second anodes 42A and 42B. The carbonate compound produced at the anodes 42A and 42B may be discharged from the first and second discharge ports 51A and 51B, respectively.

The first and second catalysts are as described in the above first embodiment, the alcohol compound as a reactant, and the carbonate compound to be produced are also as described in the first embodiment.

The internal configurations within the cathode compartment and the anode compartments are analogous to as in the first embodiment, and the anode compartment may be filled with the reactant or a liquid mixture of the reactant and the solvent, and where appropriate, an electrolyte salt can be added to the reactant or the liquid mixture. The third catalyst can be used, where appropriate. The solvent, the electrolyte salt, and the third catalyst are as described above.

As described above, also in the present embodiment, reduction of carbon dioxide is performed on the side of each of the cathode, and a carbonate compound is produced as valuables on the side of each of the anode, and as a result of this the electrical energy on the side of the anode that has not been effectively utilized in a conventional manner can be utilized in the synthesis of an industrially beneficial substance.

In the present embodiment, in a single electrochemical cell, with being equipped with two sets of the cathodes and the anodes, it is possible to use the other set of the cathode and the anode in the identical electrochemical cell as carbon monoxide sources for the one set. Therefore, a beneficial chemical substance can be efficiently produced at the anode of each of the electrochemical cells without installation of another carbon monoxide source.

In the present embodiment, two electrochemical cells are installed, and there are two sets of the cathodes and the anodes; however, three or more electrochemical cells may be installed, and three or more sets of the cathodes and the anodes may be installed. In this case, three or more sets of cathodes and anodes are opposed to one another through with the interposition of an identical ion exchange membrane. Also in the case where three or more sets are installed, carbon monoxide produced at each of the cathode is fed to the anode included in the other set, and a carbonate compound is produced resulted from the carbonylation reaction.

In the fourth embodiment, the second feed path 52B can be eliminated. Also in the case where second feed path 52B is eliminated, the carbonate compound can be produced at the first anode 42A by feeding carbon monoxide via a feed port not shown in the present figure from another carbon monoxide source to the first anode 42A (in other words, first anode compartment 46A), with regard to the first anode 42A.

Fifth Embodiment

Figure 5:
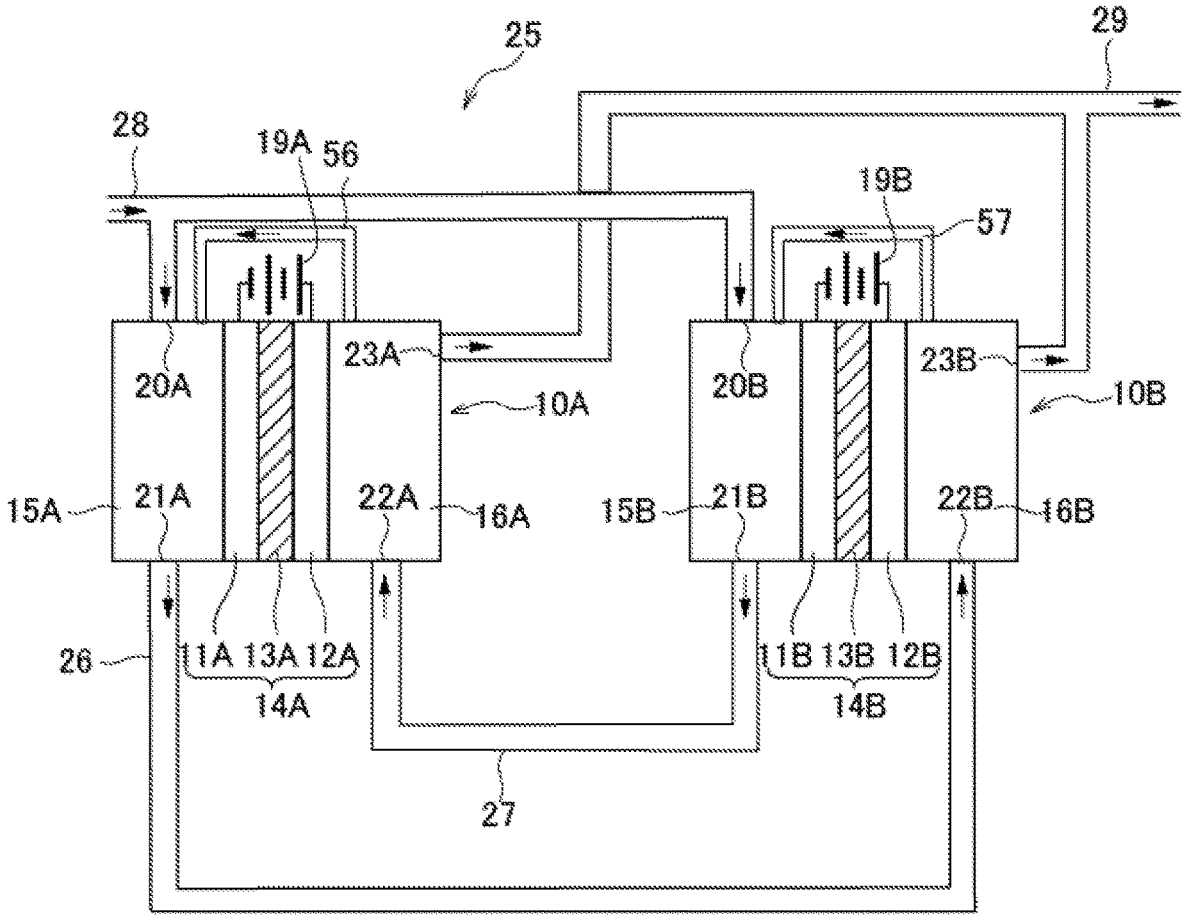
FIG. 5 is a schematic view showing an electrochemical cell according to a fifth embodiment of the present invention.

Next, an electrochemical system according to a fifth embodiment will be described with reference to FIG. 5. An electrochemical system 55 according to the present embodiment is different than the second embodiment, in that the electrochemical system 55 according to the present embodiment further includes first and second connecting paths 56 and 57. The fifth embodiment will be described below with regard to the difference between the fifth embodiment and the second embodiment.

The first and second connecting paths 56 and 57 are a path connecting an anode compartment 16A with a cathode compartment 15A, and a path connecting an anode compartment 16B with a cathode compartment 15B, respectively. The first and second connecting paths 56 and 57 make gas flow from the anode compartments 16A and 16B into the cathode compartments 15A and 15B, respectively. The first and second connecting paths 56 and 57 are, for example, conducting pipes for connecting the cathode compartment with the anode compartment, and may be equipped with, for example, a flow rate regulating mechanism to adjust the flow rate and the like. The, conducting pipe is equipped with a backflow preventing mechanism such as a non-return valve to allow for the delivery of a gas from the anode compartments 16A and 16B to the cathode compartments 15A and 15B, and not to allow for the delivery of the gas in the backward direction.

In the present embodiment, as a result of installation of the connecting paths 56 and 57, unreacted carbon dioxide that passes through the first feed path 26 or the second feed path 27 to output to the anode compartment 16B or the anode compartment 16A further passes through a second connecting path 57 or a first connecting path 56, and goes back to the cathode compartment 15B or the cathode compartment 15A. In this way, unreacted carbon dioxide circulates through the electrochemical system 55, and subjected to the first reaction on the course of this circulation, and as a result of this, the conversion rate of carbon dioxide in the overall electrochemical system can be improved.

The components that pass through the connecting paths 56 and 57 to be flown into the respective cathode compartments 15A and 15B can also include, for example, unreacted carbon monoxide that has not been used for the second reaction, in addition to the unreacted carbon dioxide described above, in which the unreacted carbon monoxide is of carbon monoxide produced in the cathode compartments 15A and 15B and output to the anode compartments 16B and 16A. As a result, in a manner analogous to as in carbon dioxide, carbon monoxide may circulate through the inside of the electrochemical system 55, and subjected to the second reaction on the course of this circulation. Consequently, the conversion rate of the final product from carbon monoxide increases.

In the fifth embodiment of the above description, the connecting path connects the anode compartment with the cathode compartment in the identical electrochemical cell; however, the connecting path may connect an anode compartment of another electrochemical cell with the cathode compartment. In other words, the connecting path can have any configuration as long as the connecting path connects any of the anode compartments in the electrochemical system with any of the cathode compartments. Furthermore, there is no need for installing two connecting paths, and there can be a single connecting path.

In addition, the electrochemical cell according to the above first embodiment, and the electrochemical system according to third and fourth embodiment can be also equipped with a connecting path connecting any of the anode compartment(s) with any of the cathode compartment(s), and unreacted carbon dioxide or carbon monoxide circulates through the electrochemical system, and subjected to the first reaction or the second reaction on the course of this circulation.

Other Embodiments

Each of the embodiments provided above illustrates one example of the present invention, and the present invention is not limited to the configurations described above.

In each of the embodiments described above, the electrochemical cell has the cell-structure in which the cell is separated into the cathode compartment and the anode compartment by the membrane-electrode assembly; however, the configuration of the electrochemical cell is not limited to such a structure, and can be any electrochemical cell having any structure, as long as effects of the present invention are accomplished.

By way of example, the electrochemical cell may have a configuration in which an electrolyte bath filled with the electrolyte solution is separated into the cathode compartment and the anode compartment by an ion exchange membrane, and the cathode and anode are disposed in the electrolyte solution of the cathode compartment and the anode compartment. In this case, by way of example, carbon dioxide and carbon monoxide may be respectively fed to the electrolyte solution in the cathode compartment and the anode compartment by bubbling or the like. The electrolyte solution in the anode compartment contains a reactant as described above. The electrolyte solution in the cathode compartment may be the same as or different from the electrolyte solution of the anode compartment.

In addition, each of the electrochemical cells may apply a voltage by using photovoltage, for example.

As described above, the present invention provides the following [1] to [48].

[1] An electrochemical cell, including a cathode, an anode, and an ion exchange membrane disposed between the cathode and the anode, wherein the cathode includes a first catalyst capable of catalyzing a reduction reaction for reducing carbon dioxide into carbon monoxide, and the anode includes a second catalyst capable of catalyzing a carbonylation reaction for producing a carbonate compound from carbon monoxide and an alcohol compound.

[2] The electrochemical cell according to the above [1], including:

a cathode compartment having the cathode disposed therein, and an anode compartment having the anode disposed therein, wherein the cathode compartment includes a feed port which enables carbon dioxide to introduce therein, and the anode compartment includes a feed port which enables carbon monoxide and an alcohol compound to introduce therein, and a discharge port capable of discharging a product produced at the anode.

[3] The electrochemical cell according to the above [2], wherein the cathode compartment includes a discharge port capable of discharging a product produced at the cathode.

[4] The electrochemical cell according to the above [3], wherein the discharge port in the cathode compartment is connected with an apparatus other than the electrochemical cell including the cathode compartment.

[5] The electrochemical cell according to the above [4], wherein the apparatus other than the electrochemical cell is any of other electrochemical cell, a reactor, and a filling apparatus.

[6] The electrochemical cell according to any of the above [1] to [5], including: a power supply connecting the cathode with the anode.

[7] The electrochemical cell according to any one of the above [1] to [6], wherein the first catalyst includes at least one substance selected from the group consisting of metal, a metal compound, a carbon compound containing a heteroelement, and a carbon compound containing a metal.

[8] The electrochemical cell according to the above [7], wherein the metal and metal in the metal compound are at least one metal selected from the group consisting of Bi, Sb, Ni, Co, Ru and Ag.

[9] The electrochemical cell according to the above [7] or [8], wherein the cathode contains at least one substance selected from the group consisting of the metal and the metal compound, and an electroconductive carbon material supporting at least one substance selected from the group consisting of the metal and the metal compound.

[10] The electrochemical cell according to any of the above [1] to [9], wherein the second catalyst includes at least one substance selected from the group consisting of metal, a metal compound and an electroconductive carbon material.

[11] The electrochemical cell according to any one of the above [10], wherein the second catalyst includes at least one element of Groups 8 to 12.

[12] The electrochemical cell according to the above [10] or [11], wherein the second catalyst includes at least one element selected from the group consisting of iron, gold, copper, nickel, platinum, palladium, ruthenium, osmium, cobalt, rhodium and iridium.

[13] The electrochemical cell according to any of the above [10] to [12], wherein the second catalyst includes palladium.

[14] The electrochemical cell according to any of the above [10] to [13], wherein the substance is a metal halide.

[15] The electrochemical cell according to any of the above [10] to [14], wherein the anode is a composite formed by mixing at least one substance selected from the group consisting of the metal and the metal compound with an electroconductive carbon material.

[16] The electrochemical cell according to the above [15], wherein the composite is a composite film formed on a substrate as an electroconductive carbon material.

[17] The electrochemical cell according to any of the above [1] to [16], wherein an alcohol compound as a reactant is filled in the inside of the anode compartment.

[18] The electrochemical cell according to the above [17], wherein the alcohol compound is filled in the anode compartment as a liquid mixture of the alcohol compound with a solvent.

[19] The electrochemical cell according to the above [17] or [18], wherein the alcohol compound or the liquid mixture further contains an electrolyte salt.

[20] The electrochemical cell according to the above [19], wherein the electrolyte salt is at least one salt selected from the group consisting of alkali metal salts, peroxides of alkali metal and ammonium salts.

[21] The electrochemical cell according to any of the above [1] to [20], wherein the ion exchange membrane is a cation exchange membrane or an anion exchange membrane.

[22] The electrochemical cell according to the above [21], wherein the ion exchange membrane is a cation exchange membrane.

[23] An electrochemical system, including: at least two electrochemical cells according to any of the above [1] to [22] as first and second electrochemical cells, wherein the electrochemical system includes a first feed path capable of feeding a product produced at a cathode of the first electrochemical cell to an anode of the second electrochemical cell.

[24] The electrochemical system according to the above [23], further including a second feed path capable of feeding a product produced at the cathode of the second electrochemical cell to the anode of the first electrochemical cell.

[25] An electrochemical system, including at least three electrochemical cells according to any of the above [1] to [22] as first, second and third electrochemical cells, wherein a first feed path capable of feeding a product produced at the cathode of the first electrochemical cell to the anode of the second electrochemical cell, and a second feed path capable of feeding a product produced at the cathode of the second electrochemical cell to the anode of the third electrochemical cell.

[26] The electrochemical system according to the above [25], further including: a third feed path capable of feeding a product produced at a cathode of the third electrochemical cell to an anode of the first electrochemical cell.

[27] The electrochemical system according to the above [23] to [26], wherein the cathode and the anode of the first electrochemical cell, as well as the cathode and the anode of the second electrochemical cell are disposed so as to be separated by an identical ion exchange membrane, the cathode of the first electrochemical cell and the anode of the second electrochemical cell are located in one section separated by the ion exchange membrane, and the cathode of the second electrochemical cell and the anode of the first electrochemical cell are located in the other section separated by the ion exchange membrane, both of the cathodes of the first and second electrochemical cells include the first catalyst, and both of the anodes of the first and second electrochemical cells include the second catalyst.

[28] The electrochemical system according to the above [27], further including a second feed path capable of feeding a product produced at the cathode of the second electrochemical cell to the anode of the first electrochemical cell.

[29] The electrochemical system according to the above [27] or [28], wherein the one section is further partitioned into two sections by at least one partition wall, and these two sections respectively constitutes a cathode compartment in the first electrochemical cell, and an anode compartment in the second electrochemical cell, the other section is further partitioned into two sections by at least one partition wall, and these two sections constitute an anode compartment in the first electrochemical cell and a cathode camber in the second electrochemical cell, respectively, and cathodes are disposed in the respective cathode compartments, and anodes are disposed in the respective anode compartments.

[30] An electrochemical system, including:

n electrochemical cells according to any of the above [1] to [22] as first, second, . . . , and nth electrochemical cells (here, n is an integer of 4 or more); and first, second, . . . , and (n-1)th feed paths capable of feeding a product produced at each of cathodes of the first, second, . . . , and (n-1)th electrochemical cells to each of anodes of the second, third, . . . , and nth electrochemical cells.

[31] The electrochemical system according to the above [30], further including: an nth feed path capable of feeding the product produced at the cathode of the nth electrochemical cell to the anode of the first electrochemical cell.

[32] The electrochemical system according to any of the above [23] to [31], wherein the first and second electrochemical cells each include both of a cathode compartment and an anode compartment, a cathode is disposed in each cathode compartment, and an anode is disposed in each anode compartment, the electrochemical system includes a connecting path connecting any of the cathode compartments with any of the anode compartments, and the connecting path enables gas to flow from the anode compartment into the cathode compartment.

[33] The electrochemical cell according to any of the above [1] to [22], or the electrochemical system according to any of the above [23] to [32], including:

one cathode compartment or two or more of cathode compartments in which or in each of which the cathode of each of the electrochemical cells is disposed; one anode compartment or two or more anode compartments in which or in each of which the anode of each of the electrochemical cells is disposed; and a connecting path connecting any of the anode compartments with any of the cathode compartments, wherein the connecting path makes gas flow from the anode compartment into the cathode compartment.

[34] A method of producing a carbonate compound in an electrochemical cell according to any of the above [1] to [22], or an electrochemical system according to any of the above [23] to [33], the method including:

a step of applying a voltage between the anode and the cathode to reduce carbon dioxide into carbon monoxide at the cathode, and to produce a carbonate compound from carbon monoxide and an alcohol compound at the anode.

[35] A method of producing a carbonate compound in an electrochemical cell including a cathode, an anode, and an ion exchange membrane disposed between the cathode and the anode, the method including:

a step of applying a voltage between the anode and the cathode to reduce carbon dioxide into carbon monoxide at the cathode, and to produce a carbonate compound from carbon monoxide and an alcohol compound at the anode.

[36] The method of producing a carbonate compound according to the above [34] or [36], wherein a reaction represented by the following formula (i) occurs at the cathode.

$$CO_2+2H^{30}+2e^- \rightarrow CO+H_2O \quad \text{(i)}$$

[37] The method of producing a carbonate compound according to any of the above [34] to [36], wherein at least one reaction represented by the following formulae (ii), (iii) and (iv) occurs at the anode.

(ii)

$$CO + 2R^1OH \longrightarrow CO(OR^1)_2 + 2H^+ + 2e^-$$

(iii)

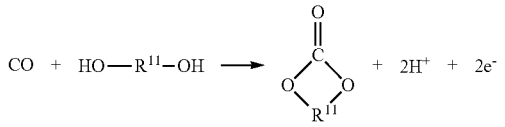

(iv)

$$CO + R^2OH + R^3OH \longrightarrow (R^2O)CO(OR^3) + 2H^+ + 2e^-$$

($R^1$, $R^2$, $R^3$, and $R^{11}$ are each independently an organic group having 1 to 15 carbon atoms, and $R^2$ and $R^3$ are groups different from each other.)

[38] The method of producing a carbonate compound according to the above [37], wherein $R^1$, $R^2$ and $R^3$ are each independently selected from hydrocarbon groups having 1 to 8 carbon atoms and optionally substituted with one halogen atom or two or more halogen atoms.

[39] The method of producing a carbonate compound according to the above [37], wherein $R^{11}$ is a hydrocarbon group having 2 to 8 carbon atoms and optionally substituted with one halogen atom or 2 or more halogen atoms.

[40] The method of producing a carbonate compound according to any of the above [34] to [39], wherein the alcohol compound is at least one selected from the group consisting of methanol, ethanol, phenol, 1-propanol, 1-butanol, ethylene glycol, 1,2-propanediol, 1,3-propanediol, 1,2-butanediol, and trichloromethanol.

[41] The method of producing a carbonate compound according to any of the above [34] to [40], wherein the carbonate compound is at least one selected from the group consisting of dimethyl carbonate, diethyl carbonate, dipropyl carbonate, dibutyl carbonate, diphenyl carbonate, ethylene carbonate, propylene carbonate, 1,2-butylene carbonate, 1,3-dioxan-2-one, triphosgene, ethyl methyl carbonate, methyl phenyl carbonate, and butyl methyl carbonate.

[42] The method of producing a carbonate compound according to any of the above [34] to [41], including:

a step of preparing at least two of the electrochemical cells as first and second electrochemical cells, and a step of feeding carbon monoxide produced at a cathode of the first electrochemical cell to an anode of the second electrochemical cell.

[43] The method of producing a carbonate compound according to the above [42], including: a step of feeding carbon monoxide produced at a cathode of the second electrochemical cell to an anode of the first electrochemical cell.

[44] The method of producing a carbonate compound according to any of the above [34] to [43], including:

a step of preparing at least three of the electrochemical cell as first, second and third electrochemical cells;

a step of feeding carbon monoxide produced at the cathode of the first electrochemical cell to the anode of the second electrochemical cell; and a step of feeding carbon monoxide produced at the cathode of the second electrochemical cell to the anode of the third electrochemical cell.

[45] The method of producing a carbonate compound according to any of the above [34] to [44], wherein the cathode and the anode of the first electrochemical cell, as well as the cathode and the anode of the second electrochemical cell are disposed so as to be separated by an identical ion exchange membrane, the cathode of the first electrochemical cell and the anode of the second electrochemical cell are located in one section separated by the ion exchange membrane, and the cathode of the second electrochemical cell and the anode of the first electrochemical cell are located in the other section separated by the ion exchange membrane, the method of producing a carbonate compound including:

a step of reducing carbon dioxide into carbon monoxide at any of the cathodes of the first and second electrochemical cells;

a step of producing a carbonate compound from carbon monoxide and an alcohol compound at any of the anodes of the first and second electrochemical cells; and a step of feeding carbon monoxide produced at the cathode of the first electrochemical cell to the anode of the second electrochemical cell.

[46] The method of producing a carbonate compound according to the above [45], further including: a step of feeding carbon monoxide produced at the cathode of the second electrochemical cell to the anode of the first electrochemical cell.

[47] The method of producing a carbonate compound according to the above [34] to [46], wherein the first and second electrochemical cells each include both of a cathode compartment and an anode compartment, the cathode is disposed in each cathode compartment, and the anode is disposed in each anode compartment, and any of carbon dioxide and carbon monoxide is flown from any of the anode compartments into any of the cathode compartments.

[48] The method of producing a carbonate compound according to any of the above [34] to [47], wherein one cathode compartment or two or more cathode compartments in which or in each of which the cathode is disposed, and one anode compartment or two or more anode compartments in which or in each of which the anode is disposed are provided, and at least one of carbon dioxide and carbon monoxide is fed into any of the cathode compartments from any of the anode compartments.

As described above, in the present invention, it is possible to provide an electrochemical cell, an electrochemical system, and a method of producing a carbonate compound, in which a carbonate compound as valuables can be produced while reducing carbon dioxide, with combining a reaction occurring at a cathode with a reaction occurring at an anode to utilize electrical energy effectively.

EXAMPLES

The present invention will be described in further detailed manner by use of Examples; however, the present invention is not limited in any way by these Examples.

Example 1

40 mg of 4,4'-dimethyl-2,2'-dipyridyl and 5 mg of Co $(NO_3)_2.6H_2O$ were mixed together in ethanol, and fired at 550° C. to obtain a reduction catalyst (a first catalyst). This catalyst and 3 mg of PTFE were dispersed in 0.3 mL of isopropanol, and applied on a carbon paper. The resulting carbon paper was dried by heating at 80° C. for one hour to obtain a cathode.

Then, 30 mg $PdCl_2$ (manufactured by Aldrich), 10 mg of mesoporous carbon (manufactured by Aldrich), and 3 mg of PTFE were dispersed in 0.5 ml of isopropanol, applied on a carbon paper, and heated at 300° C. for one hour to obtain an anode.

The resulting cathode and anode were laminated onto an ion exchange membrane consisting of Nafion (trade name), and subjected to heat pressing at 10 MPa and 413 K to fabricate a membrane-electrode assembly. The membrane-electrode assembly was set at the center of the cell to obtain an electrochemical cell separated into a cathode compartment and an anode compartment by the ion exchange membrane. The electrochemical cell has a configuration shown in FIG. 1 and corresponding to the first embodiment.

$CO_2$ (1 atm) was flown into the cathode compartment. The anode compartment was filled with methanol (reactant) containing 0.2 mol/L of LiBr (manufactured by Aldrich) as an electrolyte salt, and a mixed gas of carbon monoxide and argon (CO/Ar (volume ratio)=90/10) (1 atm) was flown thereinto.

A voltage of 2.5 V was applied between the cathode and the anode at 273 K, and the products in the cathode compartment and the anode compartment were analyzed by gas chromatography (GC).

Examples 2 to 4

Examples 2 to 4 were accomplished in a manner analogous to as in Example 1, except that the reactant was changed in a manner shown in Table 1.

Example 5

Two electrochemical cells (first and second electrochemical cells) were fabricated according to a procedure analogous to as in Example 1. The cathode compartment of the first electrochemical cell, and the anode compartment of the second electrochemical cell were connected by a Teflon (registered trade name) tube to form a first feed path. Likewise, the cathode compartment of the second electrochemical cell, and the anode compartment of the first electrochemical cell were connected by a Teflon tube to form a second feed path, so that an electrochemical system was fabricated. The electrochemical system had a configuration shown in FIG. 2 and corresponding to the second embodiment.

$CO_2$ (1 atm) was flown into each of the cathode compartments, and each of the anode compartments was filled with methanol (reactant) containing 0.2 mol/L of LiBr (manufactured by Aldrich) as an electrolyte salt.

In the first and second electrochemical cells, a voltage of 2.5 V was applied between the cathode and the anode at 273 K, the products produced at the cathode compartments of the cells were fed to the respective anode compartment via the feed path, and subjected to bubbling with the reactant in each of the anode compartments. The products in each of the cathode compartments and the anode compartments were analyzed by gas chromatography (GC).

Examples 6 to 17

Examples 6 to 17 were accomplished in a manner analogous to Example 1, except that the reactant was changed as shown in Table 1.

The reactants in Example 15 to 17 were respectively a mixture of methanol and ethanol, a mixture of methanol and phenol, and a mixture of methanol and 1-butanol, the mass ratio in these being 1:1.

Example 18

The cathodes and the anodes were fabricated according to a procedure analogous to as in Example 1. Two sets of the cathodes and the anodes were prepared as the first and second cathodes and the first and second anodes.

The first cathode and the second anode were disposed in an array on one surface of an ion exchange membrane consisting of Nafion (trade name), and the second cathode and first anode were disposed in an array on the other surface. In this case, the first cathode and the first anode, and the second anode and the second cathode are disposed so as to be opposed to one another with the interposition of the ion exchange membrane. Then, the resulting was heated with pressing at 10 MPa and 413 K to obtain a membrane-electrode assembly in which two electrodes (the first cathode and the second anode, or the second cathode and the first anode) were present at the same plane and on both surfaces of the ion exchange membrane. The above assembly was placed at the center of the cell in such a manner that the two sections separated by the ion exchange membrane were further partitioned into two spaces by the partition wall. As a result, the two spaces in the one section became a first cathode compartment and a second anode compartment, and the two spaces in the other section became a second cathode compartment and a first anode compartment. The first cathode compartment and the second anode compartment were connected by a Teflon tube to form a first feed path, and the second cathode compartment and the first anode compartment were connected by a Teflon tube to form a second feed path, and thereby an electrochemical system was obtained. The electrochemical system had a configuration shown in FIG. 4 and corresponding to the fourth embodiment.

Carbon dioxide (1 atm) was flown into the first and second cathode compartments, and the second and first anode compartments were filled with methanol (reactant) containing 0.2 mol/L of LiBr (manufactured by Aldrich) as an electrolyte salt. At 273 K, a voltage of 2.5 V was applied between the first cathode and the first anode, and between the second cathode and the second anode, and the product at each of the cathode compartments and the anode compartments was analyzed by gas chromatography (GC).

Examples 19 and 20

Examples 19 and 20 were accomplished in a manner analogous to as in Example 18, except that the reactant was changed as shown in Table 1.

Comparative Example 1

The electrochemical cell was fabricated in a manner analogous to as in Example 1, the product was evaluated, except that water containing 0.2 mol/L of LiBr (manufactured by Aldrich) as an electrolyte salt was filled instead of methanol containing LiBr within the anode compartment in Example 1.

Comparative Example 2

The electrochemical system was fabricated, and the product was evaluated in a manner analogous to Example 5, except that water containing 0.2 mol/L of LiBr (manufactured by Aldrich) as an electrolyte salt was filled instead of methanol containing LiBr within each of the anode compartments in Example 5, and in addition, the feed path connecting the first electrochemical cell with the second electrochemical cell was not installed.

Comparative Example 3

The electrochemical system was fabricated in a manner analogous to Example 5, and the product was evaluated, except for the fact that the feed path connecting the first electrochemical cell with the second electrochemical cell in Example 5 was not installed.

TABLE 1

| | Structure of Cell or System | Source material | | Product | |
|---|---|---|---|---|---|
| | | Cathode | Anode | Cathode | Anode |
| Example 1 | First Embodiment | Carbon dioxide | Methanol | Carbon monoxide | Dimethyl carbonate |
| Example 2 | First Embodiment | Carbon dioxide | Ethanol | Carbon monoxide | Diethyl carbonate |
| Example 3 | First Embodiment | Carbon dioxide | Phenol | Carbon monoxide | Diphenyl carbonate |
| Example 4 | First Embodiment | Carbon dioxide | 1-Propanol | Carbon monoxide | Dipropyl carbonate |
| Example 5 | Second Embodiment | Carbon dioxide | Methanol | Carbon monoxide | Dimethyl carbonate |
| Example 6 | Second Embodiment | Carbon dioxide | Ethanol | Carbon monoxide | Diethyl carbonate |
| Example 7 | Second Embodiment | Carbon dioxide | Phenol | Carbon monoxide | Diphenyl carbonate |
| Example 8 | Second Embodiment | Carbon dioxide | 1-Propanol | Carbon monoxide | Dipropyl carbonate |
| Example 9 | Second Embodiment | Carbon dioxide | 1-Butanol | Carbon monoxide | Dibutyl carbonate |
| Example 10 | Second Embodiment | Carbon dioxide | Ethylene glycol | Carbon monoxide | Ethylene carbonate |
| Example 11 | Second Embodiment | Carbon dioxide | 1,2-Propanediol | Carbon monoxide | Propylene carbonate |
| Example 12 | Second Embodiment | Carbon dioxide | 1,2-Butanediol | Carbon monoxide | 1,2-Butylene carbonate |
| Example 13 | Second Embodiment | Carbon dioxide | 1,3-Propanediol | Carbon monoxide | 1,3-Dioxan-2-one |
| Example 14 | Second Embodiment | Carbon dioxide | Trichloromethanol | Carbon monoxide | Triphosgene |
| Example 15 | Second Embodiment | Carbon dioxide | Methanol/Ethanol | Carbon monoxide | Ethyl methyl carbonate |
| Example 16 | Second Embodiment | Carbon dioxide | Methanol/Phenol | Carbon monoxide | Methyl phenyl carbonate |
| Example 17 | Second Embodiment | Carbon dioxide | Methanol/1-Butanol | Carbon monoxide | Butyl methyl carbonate |
| Example 18 | Fourth Embodiment | Carbon dioxide | Methanol | Carbon monoxide | Dimethyl carbonate |
| Example 19 | Fourth Embodiment | Carbon dioxide | Ethanol | Carbon monoxide | Diethyl carbonate |
| Example 20 | Fourth Embodiment | Carbon dioxide | Phenol | Carbon monoxide | Diphenyl carbonate |
| Comparative Example 1 | First Embodiment | Carbon dioxide | Water | Carbon monoxide | Oxygen |
| Comparative Example 2 | — | Carbon dioxide | Water | Carbon monoxide | Oxygen |
| Comparative Example 3 | — | Carbon dioxide | Methanol | Carbon monoxide | Carbon dioxide |

In the electrochemical cell or the electrochemical system of each of the Examples describe above, the reduction of carbon dioxide into carbon monoxide, and the synthesis of the carbonate compound as an industrially beneficial substance could be performed at the same time with effectively using electrical energy.

The invention claimed is:

1. An electrochemical cell, comprising a cathode, a cathode compartment, an anode, an anode compartment and an ion exchange membrane disposed between the cathode and the anode, wherein the cathode comprising a first catalyst capable of catalyzing a reduction reaction for reducing carbon dioxide into carbon monoxide, wherein the cathode compartment includes the cathode disposed therein;

wherein the cathode compartment comprises a cathode feed port which is configured to introduce carbon dioxide into the cathode compartment, wherein the cathode feed port includes a connection to a carbon dioxide source;

wherein the anode comprising a second catalyst capable of catalyzing a carbonylation reaction for producing a carbonate compound from carbon monoxide and an alcohol compound, wherein anode compartment includes the anode disposed therein;

wherein the alcohol compound is contained in the anode compartment; and wherein the anode compartment comprises a n anode feed port which is configured to introduce carbon monoxide wherein the anode feed port includes a connection to a carbon monoxide source and an alcohol compound into the anode compartment, and a discharge port configured to discharge a product produced at the anode.

2. The electrochemical cell according to claim 1, wherein the alcohol compound is at least one compound represented by the following formula (1):

$$R^1OH \quad (1)$$

wherein $R^1$ represents an organic group having 1 to 15 carbon atoms.

3. A method of producing a carbonate compound in the electrochemical cell of claim 1, the method comprising:

a step of applying a voltage between the anode and the cathode to reduce carbon dioxide into carbon monoxide at the cathode, and to produce a carbonate compound from carbon monoxide and an alcohol compound at the anode.

4. The method of producing a carbonate compound according to claim 3, wherein a reaction represented by the following formula (i) occurs at the cathode, and at least one reaction represented by the following formulae (ii), (iii) and (iv) occurs at the anode:

$$CO_2 + 2H^+ + 2e^- \longrightarrow CO + H_2O \quad (i)$$

$$CO + 2R^1OH \longrightarrow CO(OR^1)_2 + 2H^+ + 2e^- \quad (ii)$$

-continued (iii)

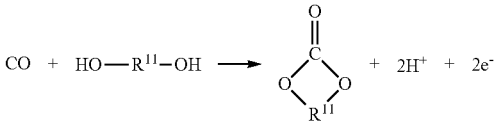

(iv)

$$CO + R^2OH + R^3OH \longrightarrow (R^2O)CO(OR^3) + 2H^+ + 2e^-$$

wherein $R^1$, $R^2$, $R^3$, and $R^{11}$ are each independently an organic group having 1 to 15 carbon atoms, and $R^2$ and $R^3$ are groups different from each other.

5. The method of producing a carbonate compound according to claim 3, wherein the carbonate compound is at least one selected from the group consisting of dimethyl carbonate, diethyl carbonate, dipropyl carbonate, dibutyl carbonate, diphenyl carbonate, ethylene carbonate, propylene carbonate, 1,2-butylene carbonate, 1,3-dioxan-2-one, triphosgene, ethyl methyl carbonate, methyl phenyl carbonate, and butyl methyl carbonate.

6. The method of producing a carbonate compound according to claim 3, comprising:

a step of preparing at least two of the electrochemical cells as first and second electrochemical cells; and a step of feeding carbon monoxide produced at the cathode of the first electrochemical cell to the anode of the second electrochemical cell.

7. The method of producing a carbonate compound according to claim 6, comprising a step of feeding carbon monoxide produced at the cathode of the second electrochemical cell to the anode of the first electrochemical cell.

8. The method of producing a carbonate compound according to claim 6, wherein the cathode and the anode of the first electrochemical cell, as well as the cathode and the anode of the second electrochemical cell are disposed so as to be separated by an identical ion exchange membrane, the cathode of the first electrochemical cell and the anode of the second electrochemical cell are located in one section separated by the ion exchange membrane, and the cathode of the second electrochemical cell and the anode of the first electrochemical cell are located in the other section separated by the ion exchange membrane, the method of producing a carbonate compound comprising:

a step of reducing carbon dioxide into carbon monoxide at any of the cathodes of the first and second electrochemical cells; and a step of producing a carbonate compound from carbon monoxide and an alcohol compound at any of the anodes of the first and second electrochemical cells.

9. The method of producing a carbonate compound according to claim 8, further comprising a step of feeding carbon monoxide produced at the cathode of the second electrochemical cell to the anode of the first electrochemical cell.

10. The method of producing a carbonate compound according to claim 6, wherein the first and second electrochemical cells each comprise both of a cathode compartment and an anode compartment, the cathode is disposed in each cathode compartment, and the anode is disposed in each anode compartment, and any of carbon dioxide and carbon monoxide is flown from any of the anode compartments into any of the cathode compartments.

11. The method of producing a carbonate compound according to claim 3, comprising:

a step of preparing at least three of the electrochemical cells as first, second and third electrochemical cells;

a step of feeding carbon monoxide produced at the cathode of the first electrochemical cell to the anode of the second electrochemical cell; and a step of feeding carbon monoxide produced at the cathode of the second electrochemical cell to the anode of the third electrochemical cell.

12. An electrochemical system, comprising at least two electrochemical cells as first and second electrochemical cells, wherein the first and second electrochemical cells each comprise a cathode, a cathode compartment, an anode, an anode compartment and an ion exchange membrane disposed between the cathode and the anode, wherein the cathode comprising a first catalyst capable of catalyzing a reduction reaction for reducing carbon dioxide into carbon monoxide, wherein the cathode compartment having the cathode disposed therein;

wherein the anode comprising a second catalyst capable of catalyzing a carbonylation reaction for producing a carbonate compound from carbon monoxide and an alcohol compound, wherein anode compartment having the anode disposed therein; and wherein the alcohol compound is contained in the anode compartment; and wherein the electrochemical system comprises a first feed path capable of feeding a product produced at a cathode of the first electrochemical cell to an anode of the second electrochemical cell.

13. The electrochemical system according to claim 12, further comprising a second feed path capable of feeding a product produced at the cathode of the second electrochemical cell to the anode of the first electrochemical cell.

14. The electrochemical system according to claim 12, wherein the cathode and the anode of the first electrochemical cell, as well as the cathode and the anode of the second electrochemical cell are disposed so as to be separated by an identical ion exchange membrane, the cathode of the first electrochemical cell and the anode of the second electrochemical cell are located in one section separated by the ion exchange membrane, and the cathode of the second electrochemical cell and the anode of the first electrochemical cell are located in the other section separated by the ion exchange membrane, both of the cathodes of the first and second electrochemical cells comprise the first catalyst, and both of the anodes of the first and second electrochemical cells comprise the second catalyst.

15. The electrochemical system according to claim 14, further comprising a second feed path capable of feeding a product produced at the cathode of the second electrochemical cell to the anode of the first electrochemical cell.

16. The electrochemical system according to claim 12, wherein the first and second electrochemical cells each comprise both of a cathode compartment and an anode compartment, the cathode is disposed in each cathode compartment, and the anode is disposed in each anode compartment, the electrochemical system comprises a connecting path connecting any of the cathode compartments with any of the anode compartments, and the connecting path enables gas to flow from the anode compartment into the cathode compartment.

17. An electrochemical system, comprising at least three electrochemical cells as first, second and third electrochemical cells, wherein the first, second and third electrochemical cells each comprise a cathode, a cathode compartment, an anode, an anode compartment and an ion exchange membrane disposed between the cathode and the anode, wherein the cathode comprising a first catalyst capable of catalyzing a reduction reaction for reducing carbon dioxide into carbon monoxide, wherein the cathode compartment having the cathode disposed therein;

wherein the anode comprising a second catalyst capable of catalyzing a carbonylation reaction for producing a carbonate compound from carbon monoxide and an alcohol compound, wherein anode compartment having the anode disposed therein; and wherein the alcohol compound is contained in the anode compartment; and wherein the electrochemical system comprises:

a first feed path capable of feeding a product produced at the cathode of the first electrochemical cell to the anode of the second electrochemical cell, and a second feed path capable of feeding a product produced at the cathode of the second electrochemical cell to the anode of the third electrochemical cell.

* * * * *